US011793379B2

(12) United States Patent
Jones et al.

(10) Patent No.: US 11,793,379 B2
(45) Date of Patent: Oct. 24, 2023

(54) FLOOR AND AIR CLEANING SYSTEMS AND RELATED METHODS

(71) Applicant: iRobot Corporation, Bedford, MA (US)

(72) Inventors: Christopher V. Jones, Woburn, MA (US); Markku Suomi, San Diego, CA (US)

(73) Assignee: iRobot Corporation, Bedford, MA (US)

( * ) Notice: Subject to any disclaimer, the term of this patent is extended or adjusted under 35 U.S.C. 154(b) by 189 days.

(21) Appl. No.: 17/214,406

(22) Filed: Mar. 26, 2021

(65) Prior Publication Data

US 2022/0304529 A1 Sep. 29, 2022

(51) Int. Cl.

| | |
|---|---|
| ***A47L 7/04*** | (2006.01) |
| ***A47L 11/40*** | (2006.01) |
| ***F24F 8/80*** | (2021.01) |
| ***F24F 120/14*** | (2018.01) |
| ***F24F 110/50*** | (2018.01) |
| ***F24F 120/12*** | (2018.01) |

(52) U.S. Cl.

CPC ..... *A47L 7/04* (2013.01); *A47L 11/4011* (2013.01); *F24F 8/80* (2021.01); *A47L 2201/00* (2013.01); *A47L 2201/04* (2013.01); *F24F 2110/50* (2018.01); *F24F 2120/12* (2018.01); *F24F 2120/14* (2018.01)

(58) Field of Classification Search

CPC ..... F24F 8/80; F24F 2110/50; F24F 2120/12; F24F 2120/14; G05B 15/02; G05B 2219/45098; G05B 2219/2638; G05B 2219/2642; G05B 2219/163; G05B 2219/2613

See application file for complete search history.

(56) References Cited

U.S. PATENT DOCUMENTS

| | | | |
|---|---|---|---|
| 9,931,007 | B2 | 4/2018 | Morin et al. |
| 2014/0207280 | A1 | 7/2014 | Duffley et al. |

(Continued)

FOREIGN PATENT DOCUMENTS

| | | | | |
|---|---|---|---|---|
| CN | 110645647 | A * | 1/2020 | |
| CN | 111856951 | A * | 10/2020 | ..... G05B 15/02 |

(Continued)

OTHER PUBLICATIONS

Translation of Eguchi-1 (JP-2010249328-A) (Year: 2010).*

(Continued)

*Primary Examiner* — Brian D Keller
*Assistant Examiner* — Steven Huang
(74) *Attorney, Agent, or Firm* — Fish & Richardson P.C.

(57) ABSTRACT

An autonomous cleaning robot includes a drive system to move the autonomous cleaning robot about a floor surface in a space, a cleaning system to clean a floor surface in the space as the drive system moves the autonomous cleaning robot about the floor surface, and a controller configured to execute instructions to perform one or more operations. The one or more operations include initiating a cleaning mission to clean the floor surface in the space, and transmitting a signal to control an operation of an air purifier remote from the autonomous cleaning robot as the autonomous cleaning robot performs the cleaning mission

22 Claims, 14 Drawing Sheets

(56) References Cited

U.S. PATENT DOCUMENTS

| | | | | |
|---|---|---|---|---|
| 2014/0207282 | A1* | 7/2014 | Angle | H04W 4/30 901/1 |
| 2015/0306533 | A1* | 10/2015 | Matlin | F24F 8/158 96/417 |
| 2016/0183752 | A1 | 6/2016 | Morin et al. | |
| 2017/0203446 | A1 | 7/2017 | Dooley et al. | |
| 2020/0077861 | A1* | 3/2020 | Kwak | A47L 11/4061 |
| 2020/0297180 | A1* | 9/2020 | Kang | A47L 9/28 |
| 2021/0089040 | A1* | 3/2021 | Ebrahimi Afrouzi | G05D 1/0248 |

FOREIGN PATENT DOCUMENTS

| | | | | |
|---|---|---|---|---|
| DE | 102016100489 | A1 * | 7/2017 | |
| EP | 3127462 | | 2/2017 | |
| EP | 3327363 | | 5/2018 | |
| EP | 3412191 | A1 * | 12/2018 | A47L 11/24 |
| EP | 3578887 | A1 * | 12/2019 | F24F 11/0008 |
| EP | 3712514 | | 9/2020 | |
| JP | 2010162263 | A * | 7/2010 | |
| JP | 2010249328 | A * | 11/2010 | |
| JP | 2017018381 | A * | 1/2017 | |
| JP | 2017029667 | A * | 2/2017 | A47L 11/4097 |
| JP | 2019202160 | A * | 11/2019 | G05B 19/42 |
| KR | 102001782 | B1 * | 7/2019 | |

OTHER PUBLICATIONS

Translation of Euuchi-2 (JP-2010162263-A) (Year: 2010).*
Translation of Erkek (EP3412191A1) (Year: 2018).*
Translation of Chen CN-111856951-A (Year: 2020).*
Translation of JP 2017018381 A (Year: 2017).*
Translation of KR 102001782 B1 (Year: 2019).*
Translation of DE-102016100489-A1 (Year: 2017).*
Translation of JP-2019202160-A (Year: 2019).*
Translation of CN-111856951-A (Year: 2020).*
Translation of JP-2017029667-A (Year: 2017).*
Translation of CN-110645647-A (Year: 2020).*
International Search Report and Written Opinion in International Appln. No. PCT/US2022/017524, dated Jun. 7, 2022, 13 pages.

* cited by examiner

FLOOR AND AIR CLEANING SYSTEMS AND RELATED METHODS

TECHNICAL FIELD

This disclosure relates to floor and air cleaning systems and related methods.

BACKGROUND

A home can include multiple devices to aid in cleaning the home, including a floor surface, air, walls, and other parts of the home. For example, a home can include an air purifier that draws air into the air purifier to filter the air. A home can also have an autonomous cleaning robot that can clean a floor surface in the home. The autonomous cleaning robot can autonomously move about the floor surface in the home while cleaning the floor surface.

SUMMARY

The technologies described in this disclosure relate to autonomous cleaning robots, air purifiers, and coordination of activities of autonomous cleaning robots and air purifiers. These technologies can allow for improved coordination of activities performed by the autonomous cleaning robots and the air purifiers. For example, an autonomous cleaning robot can perform a cleaning mission to clean a floor surface in a space, and an air purifier in the space can perform an air purifying operation. The autonomous cleaning robot and the air purifier can be controlled such that the cleaning mission and the air purifying times occur at particular times relative to one another for improving user convenience and for improving overall air and floor cleanliness in the space.

The technologies described in this disclosure also relate to user interfaces for displaying information pertaining to autonomous cleaning robots and air purifiers. These technologies can provide information to users for managing operations of autonomous cleaning robots and air purifiers, and the provided information can be generated based on sensor data collected by an autonomous cleaning robot, an air purifier, or other sensing devices in a space and based on information received from external servers. For example, an autonomous cleaning robot can collect sensor data related to debris on a floor surface in a space, and an air purifier can collect sensor data related to air quality in the space. Information can be provided to a human user based on these sensor data to provide the user with a status of the space. In addition, the information can be used to provide a recommendation for operations of the robot or the air purifier.

In one aspect, an autonomous cleaning robot includes a drive system to move the autonomous cleaning robot about a floor surface in a space, a cleaning system to clean a floor surface in the space as the drive system moves the autonomous cleaning robot about the floor surface, and a controller configured to execute instructions to perform one or more operations. The one or more operations include initiating a cleaning mission to clean the floor surface in the space, and transmitting a signal to control an operation of an air purifier remote from the autonomous cleaning robot as the autonomous cleaning robot performs the cleaning mission.

In another aspect, a method includes receiving data indicative of a location of an autonomous cleaning robot while the autonomous cleaning robot performs a cleaning mission to clean a space, determining that the location of the autonomous cleaning robot is in a room in the space in which an air purifier is located, and initiating an operation of the air purifier in response to determining that the location of the autonomous cleaning robot is in the room.

In another aspect, one or more non-transitory computer readable media are featured. The one or more non-transitory computer readable media store instructions executable by one or more processing devices, and upon such execution cause the one or more processing devices to perform one or operations. The one or more operations include receiving data indicative of a location of an autonomous cleaning robot while the autonomous cleaning robot performs a cleaning mission to clean a space, determining that the location of the autonomous cleaning robot is in a room in the space in which an air purifier is located, and initiating an operation of the air purifier in response to determining that the location of the autonomous cleaning robot is in the room.

In another aspect, an air purifier includes a base to support the air purifier above a floor surface in a space, a fan system to draw air into the air purifier, a filter to capture particles in the air drawn into the air purifier by the fan system, and a controller configured to execute instructions to perform one or more operations. The one or more operations includes adjusting a setting of the fan system in response to an autonomous cleaning robot, during a cleaning mission, entering into a region in the space within which the air purifier is located.

Implementations can include one or more of the features discussed below or elsewhere in the disclosure.

In some implementations, transmitting the signal to control the operation of the air purifier includes causing the air purifier to initiate a first mode of the air purifier. In some implementations, initiating the operation of the air purifier in response to the determining that the location of the autonomous cleaning robot is in the room includes initiating a first mode of the air purifier. In some implementations, adjusting the setting of the fan system of the air purifier includes initiating a first mode of the air purifier. The air purifier can be operable in the first mode and in a second mode. A fan speed of the air purifier in the first mode can be greater than the fan speed of the air purifier in the second mode.

In some implementations, transmitting the signal to control the operation of the air purifier includes causing the air purifier to activate in response to the autonomous cleaning robot being in a room in which the air purifier is located.

In some implementations, the one or more operations of the controller of the autonomous cleaning robot includes receiving data to cause the autonomous cleaning robot to perform a cleaning operation, the cleaning operation selected based on at least data indicative of air quality measured by the air purifier.

In some implementations, the one or more operations of the controller of the autonomous cleaning robot includes receiving data to cause the autonomous cleaning robot to perform a cleaning operation at a scheduled time. The scheduled time can be selected based on at least data indicative of air quality measured by the air purifier.

In some implementations, the one or more operations of the controller of the autonomous cleaning robot includes receiving data to cause the autonomous cleaning robot to perform a cleaning operation at a scheduled time. The scheduled time can be selected based on at least data indicative of an environmental condition.

In some implementations, the autonomous cleaning robot further includes an air quality sensor to measure air quality in the space as the drive system of the autonomous cleaning robot moves the autonomous cleaning robot moves about the floor surface. In some implementations, the one or more operations of the controller of the autonomous cleaning robot includes initiating a mission in which the autonomous cleaning robot moves about the floor surface while using the air quality sensor to measure the air quality while the cleaning system is inactive. In some implementations, the one or more operations of the controller of the autonomous cleaning robot includes transmitting data indicative of the air quality measured by the air quality sensor to cause the air purifier to operate based on at least the data indicative of the air quality measured by the air quality sensor. In some implementations, transmitting the data indicative of the air quality measured by the air quality sensor to cause the air purifier to operate based on at least the data indicative of the air quality measured by the air quality sensor includes transmitting the data indicative of the air quality measured by the air quality sensor to change a setting of the air purifier based on at least the data indicative of the air quality measured by the air quality sensor. In some implementations, the one or more operations of the controller of the autonomous cleaning robot includes transmitting data indicative of the air quality measured by the air quality sensor to provide a user indication of the measured air quality. In some implementations, the one or more operations of the controller of the autonomous cleaning robot includes transmitting data indicative of the measured air quality to provide a recommended location for the air purifier in the space.

In some implementations, the one or more operations of the controller of the autonomous cleaning robot further includes receiving data indicative of priorities for cleaning a plurality of rooms in the space during the cleaning mission, the plurality of rooms including the room, the priorities selected based on at least values of air quality in the plurality of rooms in the space. The data can be received from a remote server, a remote computing device, a user computing device, or other computing device.

In some implementations, the autonomous cleaning robot further includes a sensor to detect debris in the space. Transmitting the signal to control the operation of the air purifier can include transmitting data indicative of the detected debris. In some implementations, the data indicative of the detected debris is indicative of a type of the detected debris.

In some implementations, the autonomous cleaning robot further includes a sensor to detect a floor type in the space. Transmitting the signal to control the operation of the air purifier can include transmitting data indicative of the detected floor type.

In some implementations, the method or the one or more operations of the one or more processing devices further includes synchronizing a schedule of the air purifier with a schedule of the autonomous cleaning robot.

In some implementations, the method further includes receiving data indicative of an occupant schedule indicating a time period in which an occupant is absent from the room in the space, and initiating the cleaning mission of the autonomous cleaning robot only during the time period. In some implementations, the method further includes determining the occupant schedule based on location data generated by a mobile device carried by the occupant. In some implementations, the occupant schedule is a user-inputted occupant schedule.

In some implementations, the method further includes receiving, from the air purifier, data indicative of an air quality in the space measured by an air quality sensor of the air purifier, and initiating the cleaning mission of the autonomous cleaning robot in response to the data indicative of the air quality.

In some implementations, the method further includes generating priorities for cleaning a plurality of rooms in the space based on at least values of air quality in the plurality of rooms, the plurality of rooms including the room, causing the autonomous cleaning robot to clean the plurality of rooms during the cleaning mission in an order based on at least the priorities.

In some implementations, the method further includes receiving, from a plurality of air quality sensors in the space, data indicative of values of air quality in a plurality of rooms in the space. In some implementations, the plurality of air quality sensors include a first air quality sensor of the autonomous cleaning robot and a second air quality sensor of the air purifier. In some implementations, the plurality of air quality sensors are air quality sensors of a plurality of air purifiers in the space, the plurality of air purifiers including the air purifier. In some implementations, the method further includes generating a user indication of the values of air quality in the plurality of rooms. In some implementations, the method further includes providing a recommended location for placing the air purifier in the space based on the values of air quality. In some implementations, the method further includes providing a recommended schedule for operating the air purifier and the autonomous cleaning robot based on the values of air quality.

In some implementations, the method further includes generating an operating schedule for the autonomous cleaning robot based on at least an environmental condition, and generating an operating schedule for the air purifier based on at least the environmental condition.

In some implementations, the method further includes adjusting a setting of the air purifier based on a floor type of the room detected by the autonomous cleaning robot.

In some implementations, the method further includes adjusting a setting of the air purifier based on debris detected by the autonomous cleaning robot.

In some implementations, the method further includes providing a representation of a map of the space and providing, overlaid on the representation of the map, one or more indicators of values of air quality in the space. In some implementations, the method further includes providing, overlaid on the representation of the map, an indicator of a location of the autonomous cleaning robot and an indicator of a location of the air purifier.

In some implementations, the air purifier further includes an air quality sensor to measure an air quality in a room in which the air purifier is positioned. The one or more operations of the controller of the air purifier can include transmitting data indicative of the measured air quality to cause the autonomous cleaning robot to initiate the cleaning mission.

In some implementations, the one or more operations of the controller of the air purifier further includes receiving data indicative an air quality measured by an air quality sensor of the autonomous cleaning robot, and activating the fan system in response to the measured air quality.

In some implementations, the one or more operations of the controller of the air purifier further includes operating the fan system in accordance with a schedule synchronized with a schedule of the autonomous cleaning robot.

In some implementations, the one or more operations of the controller of the air purifier further includes adjusting the setting of the fan system based on at least data indicative of debris detected in the space by the autonomous cleaning robot.

In some implementations, the one or more operations of the controller of the air purifier further includes adjusting the setting of the fan system based on at least data indicative of a floor type in the space by the autonomous cleaning robot.

In some implementations, the air purifier further includes a drive system to move the air purifier about the floor surface.

Advantages of the foregoing may include, but are not limited to, those described below and elsewhere in this disclosure.

Certain implementations can improve coordination of activities of the devices with one another and with activities of a user in a space. Rather than a user having to manually determine and control activities of autonomous cleaning robots and air purifiers in a space, a user can control activities of autonomous cleaning robots and air purifiers based on recommended control strategies, or the activities of the autonomous cleaning robots and the air purifiers can be automatically controlled. This can allow occupants of a space to benefit from the cleaning and filtering operations of the autonomous cleaning robots and the air purifiers without having to spend a large amount of time adjusting schedules and settings for these devices. Such implementations can also simplify user management of operations of autonomous cleaning robot and air purifiers, allowing the user to access a single application for a computing device to control, manage, and oversee operations of both autonomous cleaning robot and air purifiers operating in a space.

Certain implementations can improve efficiency and efficacy of filtering operations of air purifiers and cleaning operations of autonomous cleaning robots. For example, a filter operation of an air purifier may more effectively clean air in a room when an autonomous cleaning robot is also performing a cleaning operation. If the robot is a robotic vacuum cleaner, the cleaning operation of the robot can affect air circulation in the space and can dislodge particulates on the floor surface to become entrained in the air. By operating during the cleaning operation of the robot or operating with a particular setting during the cleaning operation of the robot, the air purifier can capture at least some of these particulates before they settle on surfaces in the space. In other examples, the air purifiers and the autonomous cleaning robots can be operated based on conditions outside of the space that may increase the incidence of contaminants within the space. As a result, the air purifiers and the robots can help to prevent accumulation of contaminants in the space.

The details of one or more implementations of the subject matter described in this disclosure are set forth in the accompanying drawings and the description below. Other potential features, aspects, and advantages will become apparent from the description, the drawings, and the claims.

DETAILED DESCRIPTION

Figure 1A:
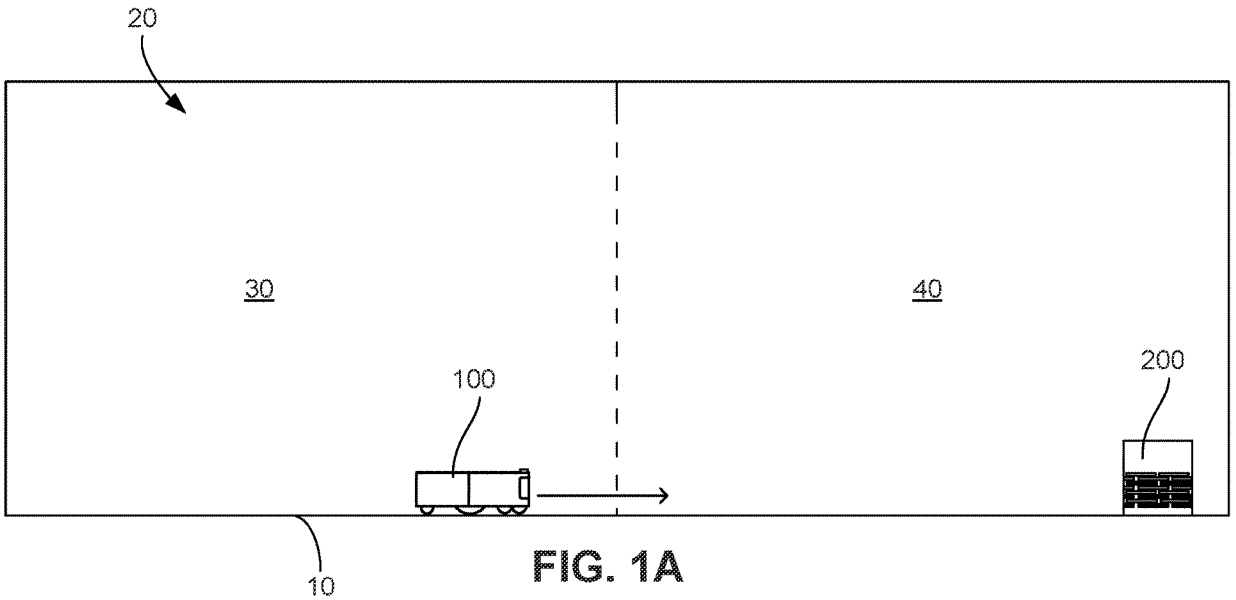
FIG. 1A and FIG. 1B are side views of an autonomous cleaning robot and an air purifier in a space.
Figure 1B:
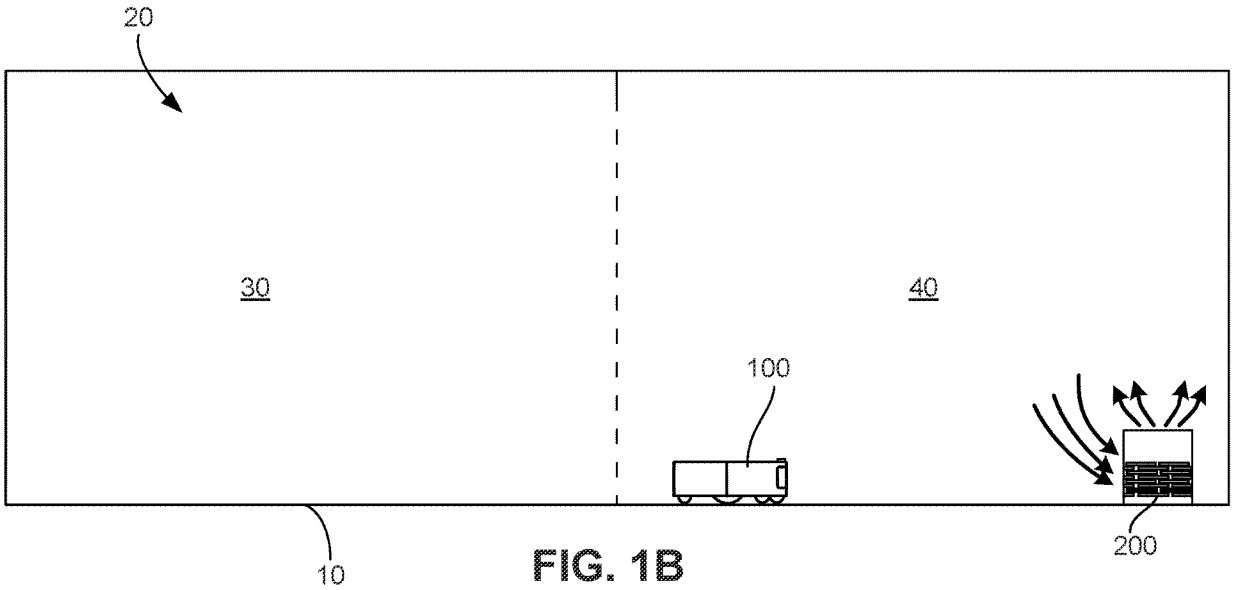

Autonomous cleaning robots can automatically clean a floor surface in a space, and air purifiers can draw in air to filter out particulates. Referring to FIG. 1A, an autonomous cleaning robot 100, e.g., a robotic vacuum cleaner, an autonomous mopping robot, an autonomous scrubbing robot, or other type of cleaning robot, moves about a floor surface 10 in a space 20. An air purifier 200, e.g., a stationary air purifier, is positioned above the floor surface 10 and is configured to draw air, filter particulates out of the air, and then expel the air back into the space 20. The space 20 can include multiple regions, e.g., a first room 30 and a second room 40. As the robot 100 moves about the floor surface 10, the robot 100 cleans the floor surface 10. As shown in FIG. 1A, the robot 100 is in the first room 30, and an air purifier 200 is in the second room 40. The air purifier 200 can be controlled in response to the robot 100 moving from the first room 30 to the second room 40. The robot 100 can initiate a cleaning mission to clean the floor surface 10 in the space 20. In addition, the robot 100 can transmit a signal that is in turn used to control an operation of the air purifier 200 as the robot 100 performs the cleaning mission. The air purifier 200 or a remote system (not shown) in communication with the air purifier 200 and the robot 100 can receive data indicative of a location of the robot 100 while the robot 100 performs the cleaning mission, and then an operation of the air purifier 200 can be controlled based on the location of the robot 100, e.g., when a location of the robot 100 corresponds to a room within which the air purifier 200 is positioned. For example, as shown in FIG. 1B, a location of the robot 100 can be determined to correspond to a region or a room within which the air purifier 200 is located, and then an operation of the air purifier 200 can be initiated in response to this determination. In response to the robot 100 moving into the second room 40, the air purifier 200 can initiate a filtering operation in which the air purifier 200 draws air into the air purifier, filters the air, and then expels the filtered air back into the space 20. In other implementations, the air purifier 200 can generate sensor data representing an air quality in the space 20, and the robot 100 can operate based on the sensor data generated by the air purifier 200. As described in this disclosure, this coordinated control of the air purifier 200 and/or the robot 100 can improve cleaning efficiency and efficacy and improve a user's ability to manage and control the operations of the robot 100 and the air purifier 200.

Figure 2:
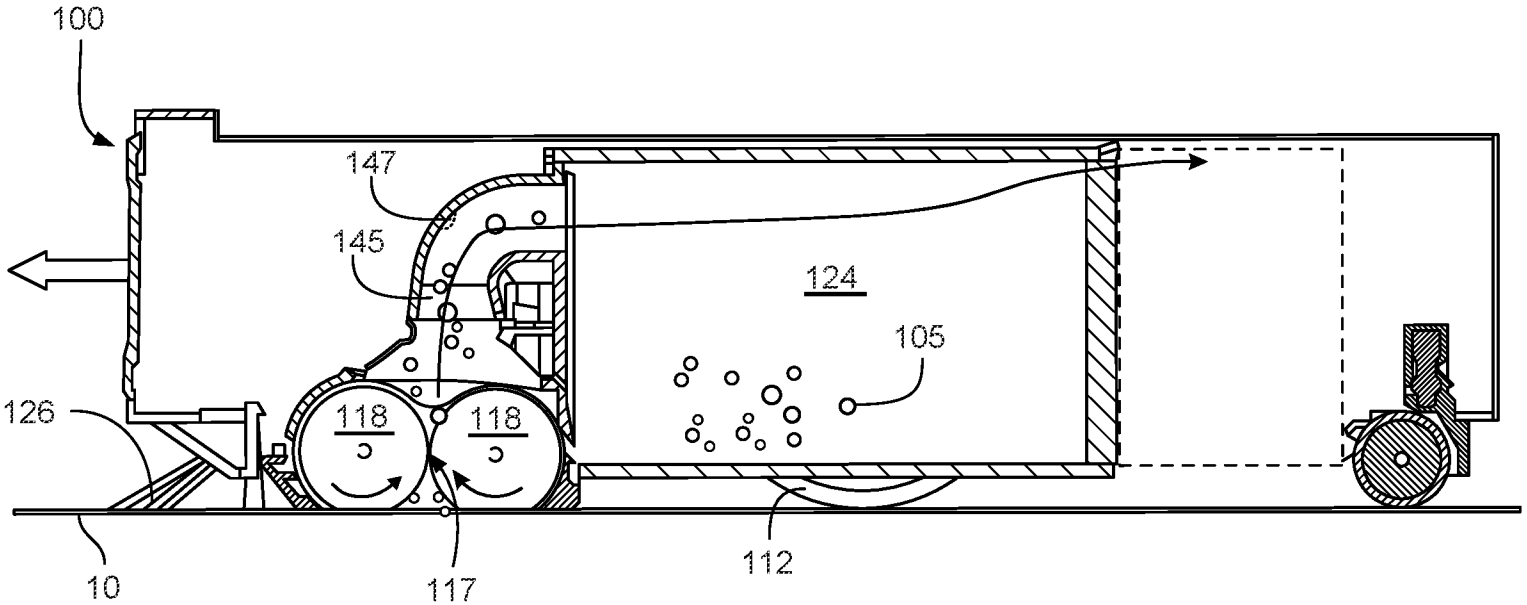
FIG. 2 is a side view of the autonomous cleaning robot of FIG. 1.
Figure 3A:
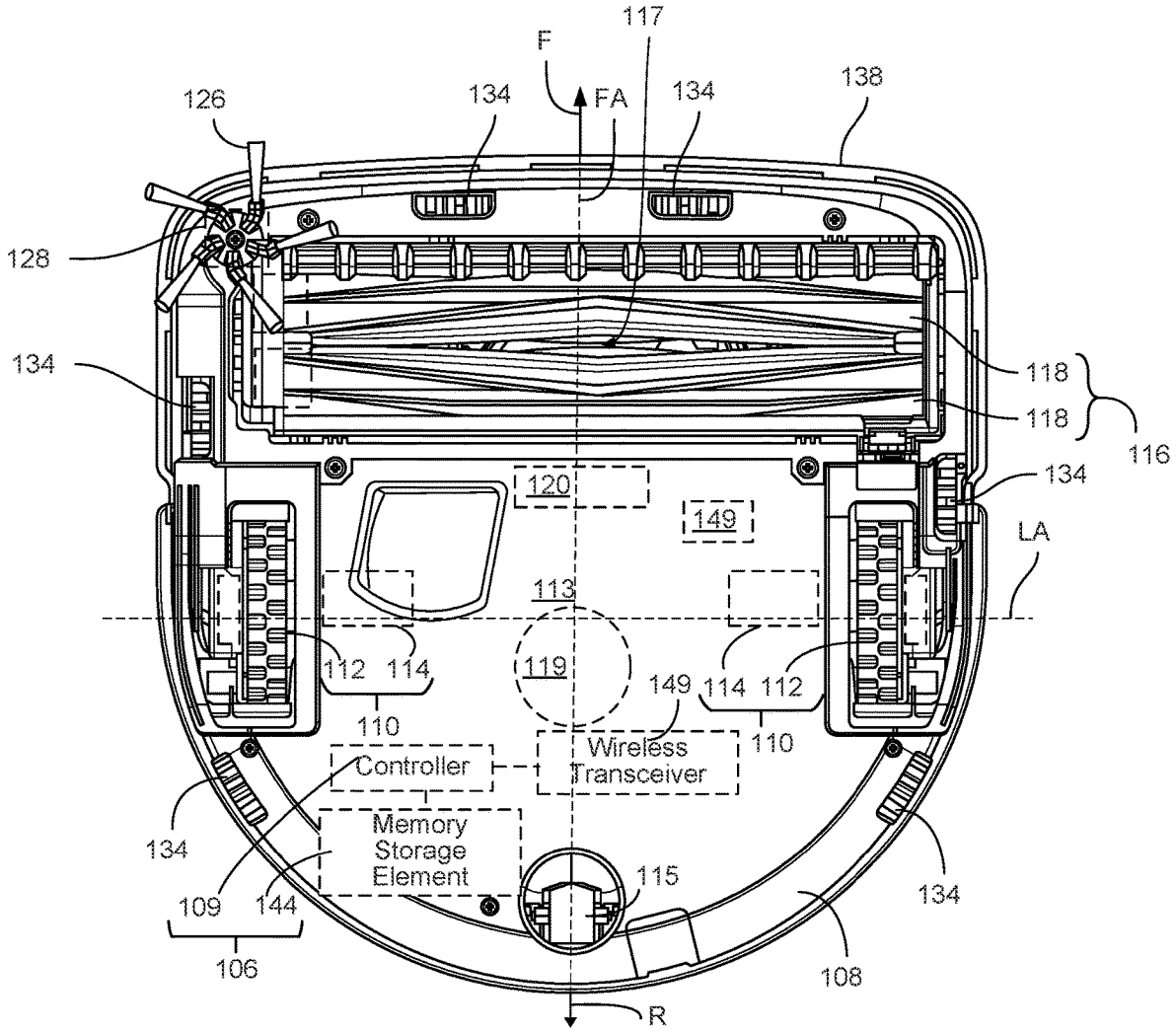
FIGS. 3A-3B are bottom and perspective views of the autonomous cleaning robot of FIG. 1.
Figure 3B:
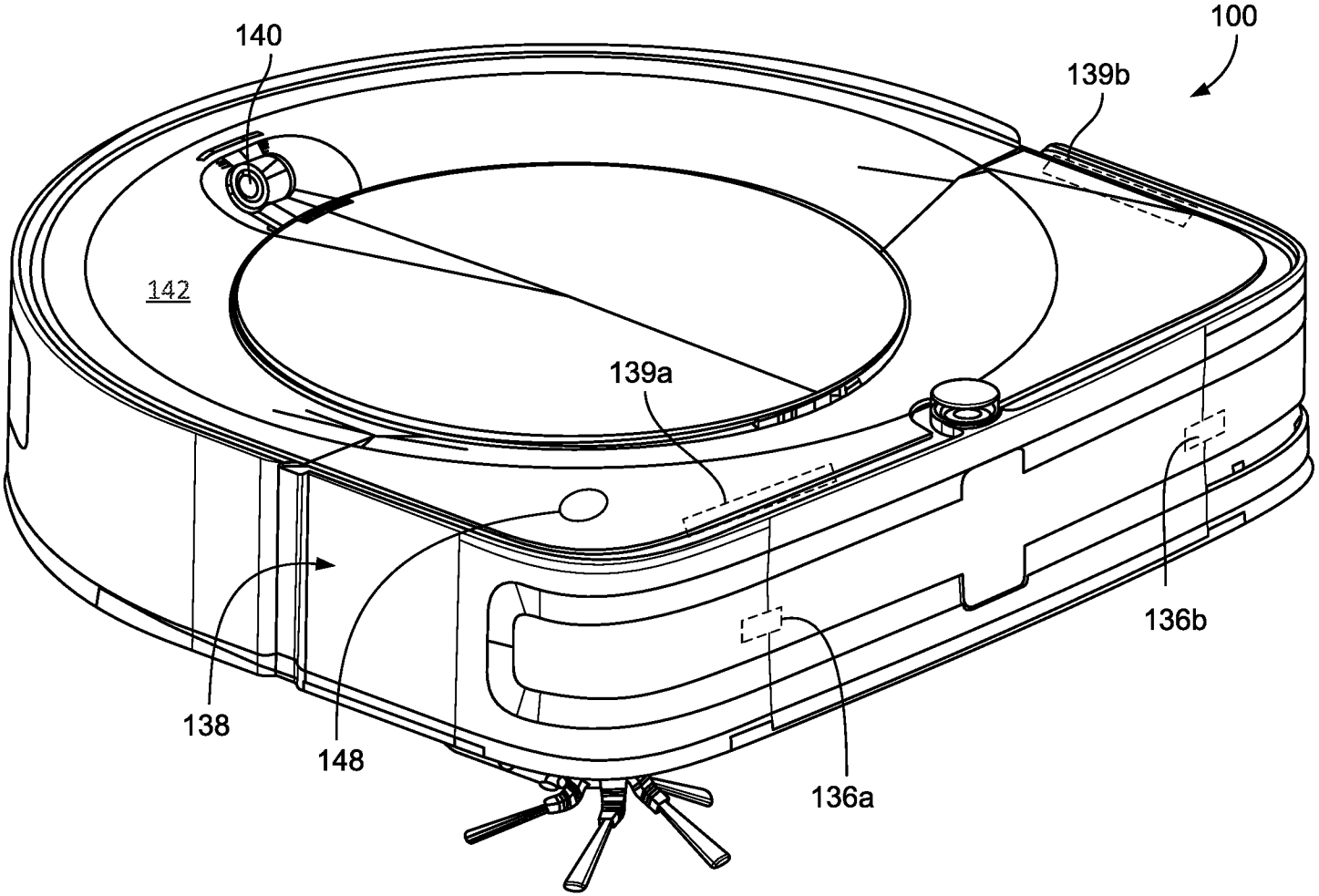

Autonomous cleaning robots can vary in implementations. FIGS. 2 and 3A-3B illustrate examples of the robot 100. Referring to FIG. 2, the robot 100 collects debris 105 from the floor surface 10 as the robot 100 traverses the floor surface 10.

Referring to FIG. 3A, the robot 100 includes a robot housing infrastructure 108. The housing infrastructure 108 can define the structural periphery of the robot 100. In some examples, the housing infrastructure 108 includes a chassis, cover, bottom plate, and bumper assembly. The robot 100 is a household robot that has a small profile so that the robot 100 can fit under furniture within a home. For example, a height H1 (shown in FIG. 2) of the robot 100 relative to the floor surface is, for example, no more than 13 centimeters.

The robot 100 is also compact. An overall length L1 (shown in FIG. 2) of the robot 100 and an overall width W1 (shown in FIG. 3A) are each between 30 and 60 centimeters, e.g., between 30 and 40 centimeters, 40 and 50 centimeters, or 50 and 60 centimeters. The overall width W1 can correspond to a width of the housing infrastructure 108 of the robot 100. The robot 100 includes a forward portion that is substantially rectangular and a rearward portion that is substantially semicircular.

The robot 100 includes a drive system 110 including one or more drive wheels. The drive system 110 is configured to move the robot 100 about the floor surface 10 in the space 20. The drive system 110 further includes one or more electric motors including electrically driven portions forming part of the electrical circuitry 106. The housing infrastructure 108 supports the electrical circuitry 106, including at least a controller 109, within the robot 100.

The drive system 110 is operable to propel the robot 100 across the floor surface 10. The robot 100 can be propelled in a forward drive direction F or a rearward drive direction R. The robot 100 can also be propelled such that the robot 100 turns in place or turns while moving in the forward drive direction F or the rearward drive direction R. In the example depicted in FIGS. 2 and 3A, the robot 100 includes drive wheels 112 extending through a bottom portion 113 of the housing infrastructure 108. The drive wheels 112 are rotated by motors 114 to cause movement of the robot 100 along the floor surface 10. The robot 100 further includes a passive caster wheel 115 extending through the bottom portion 113 of the housing infrastructure 108. In the implementations of the robot 100 depicted in FIGS. 2 and 3A, the caster wheel 115 is not powered. Together, the drive wheels 112 and the caster wheel 115 cooperate to support the housing infrastructure 108 above the floor surface 10. For example, the caster wheel 115 is disposed along the rearward portion of the housing infrastructure 108, and the drive wheels 112 are disposed forward of the caster wheel 115.

In the example depicted in FIGS. 2, 3A, and 3B, the robot 100 is an autonomous mobile floor cleaning robot that includes a cleaning system 116 (shown in FIG. 3A) operable to clean the floor surface 10. The cleaning system 116 is configured to clean the floor surface 10 in the space 20 as the drive system 110 moves the robot 100 about the floor surface 10. For example, the robot 100 is a vacuum cleaning robot in which the cleaning system 116 is operable to clean the floor surface 10 by ingesting debris 105 (shown in FIG. 2) from the floor surface 10. The cleaning system 116 includes a cleaning inlet 117 through which debris is collected by the robot 100. The cleaning inlet 117 is positioned forward of a center of the robot 100 and along the forward portion of the robot 100 between the side surfaces of the forward portion.

The cleaning system 116 includes one or more rotatable members, e.g., rotatable members 118 driven by a motor 120. The rotatable members 118 extend horizontally across the forward portion of the robot 100. The rotatable members 118 are positioned along a forward portion of the housing infrastructure 108, and extend along 75% to 95% of a width of the forward portion of the housing infrastructure 108, e.g., corresponding to an overall width W1 of the robot 100. Referring also to FIG. 2, the cleaning inlet 117 is positioned between the rotatable members 118.

As shown in FIG. 2, the rotatable members 118 are rollers that counter rotate relative to one another. For example, the rotatable members 118 can be rotatable about parallel horizontal axes to agitate debris 105 on the floor surface 10 and direct the debris 105 toward the cleaning inlet 117, into the cleaning inlet 117, and into a suction pathway 145 (shown in FIG. 2) in the robot 100. Referring back to FIG. 3A, the rotatable members 118 can be positioned entirely within the forward portion of the robot 100. The rotatable members 118 include elastomeric shells that contact debris 105 on the floor surface 10 to direct debris 105 through the cleaning inlet 117 between the rotatable members 118 and into an interior of the robot 100, e.g., into a debris bin 124 (shown in FIG. 2), as the rotatable members 118 rotate relative to the housing infrastructure 108. The rotatable members 118 further contact the floor surface 10 to agitate debris 105 on the floor surface 10.

The robot 100 further includes a vacuum system 119 operable to generate an airflow through the cleaning inlet 117 between the rotatable members 118 and into the debris bin 124. The vacuum system 119 includes an impeller and a motor to rotate the impeller to generate the airflow. The vacuum system 119 cooperates with the cleaning system 116 to draw debris 105 from the floor surface 10 into the debris bin 124. In some cases, the airflow generated by the vacuum system 119 creates sufficient force to draw debris 105 on the floor surface 10 upward through the gap between the rotatable members 118 into the debris bin 124. In some cases, the rotatable members 118 contact the floor surface 10 to agitate the debris 105 on the floor surface 10, thereby allowing the debris 105 to be more easily ingested by the airflow generated by the vacuum system 119.

The robot 100 further includes a brush 126 that rotates about a non-horizontal axis. The robot 100 includes a motor 128 operably connected to the brush 126 to rotate the brush 126. The brush 126 is a side brush laterally offset from a fore-aft axis FA of the robot 100 such that the brush 126 extends beyond an outer perimeter of the housing infrastructure 108 of the robot 100 and can thereby be capable of engaging debris on portions of the floor surface 10 that the rotatable members 118 typically cannot reach, e.g., portions of the floor surface 10 outside of a portion of the floor surface 10 directly underneath the robot 100.

The electrical circuitry 106 includes, in addition to the controller 109, a memory storage element 144 and a sensor system with one or more electrical sensors, for example. The sensor system, as described herein, can generate a signal indicative of a current location of the robot 100, and can generate signals indicative of locations of the robot 100 as the robot 100 travels along the floor surface 10. The controller 109 is configured to execute instructions to perform one or more operations as described herein. The memory storage element 144 is accessible by the controller 109 and disposed within the housing infrastructure 108. The one or more electrical sensors are configured to detect features in the space 20.

For example, referring to FIG. 3A, the sensor system includes cliff sensors 134 disposed along the bottom portion 113 of the housing infrastructure 108. Each of the cliff sensors 134 is an optical sensor that can detect the presence or the absence of an object below the optical sensor, such as the floor surface 10. The cliff sensors 134 can thus detect obstacles such as drop-offs and cliffs below portions of the robot 100 where the cliff sensors 134 are disposed and redirect the robot accordingly.

Referring to FIG. 3B, the sensor system includes one or more proximity sensors that can detect objects along the floor surface 10 that are near the robot 100. For example, the sensor system can include proximity sensors 136*a*, 136*b* disposed proximate the forward surface of the housing infrastructure 108. Each of the proximity sensors 136*a*, 136*b* includes an optical sensor facing outward from the forward surface of the housing infrastructure 108 and that can detect the presence or the absence of an object in front of the optical sensor. For example, the detectable objects include obstacles such as furniture, walls, persons, and other objects in the space of the robot 100.

The sensor system includes a bumper system including the bumper 138 and one or more bump sensors that detect contact between the bumper 138 and obstacles in the space. The bumper 138 forms part of the housing infrastructure 108. For example, the bumper 138 can form the side surfaces and the forward surface of the forward portion of the robot 100. The sensor system, for example, can include the bump sensors 139*a*, 139*b*. The bump sensors 139*a*, 139*b* can include break beam sensors, capacitive sensors, or other sensors that can detect contact between the robot 100, e.g., the bumper 138, and objects in the space. In some implementations, the bump sensor 139*a* can be used to detect movement of the bumper 138 along the fore-aft axis FA (shown in FIG. 3A) of the robot 100, and the bump sensor 139*b* can be used to detect movement of the bumper 138 along the lateral axis LA (shown in FIG. 3A) of the robot 100. The proximity sensors 136*a*, 136*b* can detect objects before the robot 100 contacts the objects, and the bump sensors 139*a*, 139*b* can detect objects that contact the bumper 138, e.g., in response to the robot 100 contacting the objects.

The sensor system further includes an image capture device 140, e.g., a camera, directed toward a top portion 142 of the housing infrastructure 108. The image capture device 140 generates digital imagery of the space of the robot 100 as the robot 100 moves about the floor surface 10. The image capture device 140 is angled in an upward direction, e.g., angled between 30 degrees and 80 degrees from the floor surface 10 about which the robot 100 navigates. The camera, when angled upward, is able to capture images of wall surfaces of the space so that features corresponding to objects on the wall surfaces can be used for localization.

The sensor system can further include sensors for tracking a distance traveled by the robot 100. For example, the sensor system can include encoders associated with the motors 114 for the drive wheels 112, and these encoders can track a distance that the robot 100 has traveled. In some implementations, the sensor system includes an optical sensor facing downward toward a floor surface. The optical sensor can be an optical mouse sensor. For example, the optical sensor can be positioned to direct light through a bottom surface of the robot 100 toward the floor surface 10. The optical sensor can detect reflections of the light and can detect a distance traveled by the robot 100 based on changes in floor features as the robot 100 travels along the floor surface 10.

The sensor system can further include a debris detection sensor 147 for detecting debris on the floor surface 10. The debris detection sensor 147 can be used to detect portions of the floor surface 10 in the space that are dirtier than other portions of the floor surface 10 in the space. In some implementations, the debris detection sensor 147 (shown in FIG. 2) is capable of detecting an amount of debris, or a rate of debris, passing through the suction pathway 145. The debris detection sensor 147 can be used to detect debris already ingested into the robot 100 or to detect debris on the floor surface 10 without the robot 100 having to ingest the debris for the debris detection sensor 147 to detect the debris. The debris detection sensor 147 can detect information representing a type of the debris, e.g., a size, a texture, whether the debris can be ingested into the robot 100, or other information about the debris that can be used to categorize the debris.

The debris detection sensor 147 can be an optical sensor configured to detect debris as it passes through the suction pathway 145. Alternatively, the debris detection sensor 147 can be a piezoelectric sensor that detects debris as the debris impacts a wall of the suction pathway 145. In some implementations, the debris detection sensor 147 detects debris before the debris is ingested by the robot 100 into the suction pathway 145. The debris detection sensor 147 can be, for example, an image capture device that captures images of a portion of the floor surface 10 ahead of the robot 100. The image capture device can be positioned on a forward portion of the robot 100 can be directed in such a manner to detect debris on the portion of the floor surface 10 ahead of the robot 100. The controller 109 can then use these images to detect the presence of debris on this portion of the floor surface 10.

The sensor system can further include an air quality sensor 148 (shown in FIG. 3B) for measuring an air quality in the space as the drive system 110 moves the robot 100 about the floor surface 10. The air quality sensor 148 can be configured to detect different sizes of contaminants, e.g., biological contaminants, particulate matter, vaporous contaminants, gaseous contaminants, ultrafine particulate matter (e.g., particulate matter that is 0.1 micrometers or smaller, also referred to as PM0.1), fine particulate matter (e.g., particulate matter that is 2.5 micrometers or smaller, also referred to as PM2.5), coarse particulate matter (e.g., particulate matter that is 10 micrometers or smaller, also referred to as PM10), volatile organic compounds, and other contaminants. The air quality sensor 148 can collect information about the air quality that can be used to compute an index for air quality, e.g., Air Quality Index (AQI).

The sensor system can further include a floor type sensor 149 (shown in FIG. 3A) for detecting a floor type of the floor surface 10 as the robot 100 moves about the floor surface 10. The floor type sensor 149 can be an optical sensor directed toward the floor surface 10. In some implementations, the floor type sensor 149 is an image capture device (e.g., a camera). As discussed in this disclosure, information about the floor type detected by the floor type sensor 149 of the robot 100 can be used to control operations of the air purifier 200. In some implementations, the floor type sensor 149 can function as one of the cliff sensors 134, while in other implementations, the floor type sensor 149 is distinct from the cliff sensors 134. Furthermore, in some implementations, the floor type sensor 149 can be an optical mouse sensor that is also used as an odometry sensor.

The controller 109 uses data collected by the sensors of the sensor system to control navigational behaviors of the robot 100 during the mission. For example, the controller 109 uses the sensor data collected by obstacle detection sensors of the robot 100, e.g., the cliff sensors 134, the proximity sensors 136*a*, 136*b*, and the bump sensors 139*a*, 139*b*, to enable the robot 100 to avoid obstacles within the space of the robot 100 during the mission.

The sensor data can be used by the controller 109 for simultaneous localization and mapping (SLAM) techniques in which the controller 109 extracts features of the space represented by the sensor data and constructs a map of the floor surface 10 of the space. The sensor data collected by the image capture device 140 can be used for techniques such as vision-based SLAM (VSLAM) in which the controller 109 extracts visual features corresponding to objects in the space and constructs the map using these visual features. As the controller 109 directs the robot 100 about the floor surface 10 during the mission, the controller 109 uses SLAM techniques to determine a location of the robot 100 within the map by detecting features represented in collected sensor data and comparing the features to previously stored features. The map formed from the sensor data can indicate locations of traversable and nontraversable space within the space. For example, locations of obstacles are indicated on the map as nontraversable space, and locations of open floor space are indicated on the map as traversable space.

In some implementations, the image capture device 140 can be used to capture imagery to identify devices in the space 20. For example, if the space 20 includes air purifiers or other sensing device (as discussed in connection with FIG. 7 of this disclosure), the image capture device 140 of the robot 100 can be used to detect these devices so that the map can indicate the locations of these devices in the space 20. The image capture device 140 can also be used to capture imagery to identify airflow devices, such as vents connected to a ventilation system of the space 20, ceiling fans, windows, and other devices in the space 20 that can passively or actively circulate the air in the space 20.

The sensor data collected by any of the sensors can be stored in the memory storage element 144. In addition, other data generated for the SLAM techniques, including mapping data forming the map, can be stored in the memory storage element 144. These data produced during the mission can include persistent data that are produced during the mission and that are usable during a further mission. For example, the mission can be a first mission, and the further mission can be a second mission occurring after the first mission. In addition to storing the software for causing the robot 100 to perform its behaviors, the memory storage element 144 stores sensor data or data resulting from processing of the sensor data for access by the controller 109 from one mission to another mission. For example, the map is a persistent map that is usable and updateable by the controller 109 of the robot 100 from one mission to another mission to navigate the robot 100 about the floor surface 10.

The persistent data, including the persistent map, enable the robot 100 to efficiently clean the floor surface 10. For example, the persistent map enables the controller 109 to direct the robot 100 toward open floor space and to avoid nontraversable space. In addition, for subsequent missions, the controller 109 is able to plan navigation of the robot 100 through the space using the persistent map to optimize paths taken during the missions.

When the controller 109 causes the robot 100 to perform the mission, the controller 109 operates the motors 114 to drive the drive wheels 112 and propel the robot 100 along the floor surface 10. In addition, the controller 109 operates the motor 120 to cause the rotatable members 118 to rotate, operates the motor 128 to cause the brush 126 to rotate, and operates the motor of the vacuum system 119 to generate the airflow. To cause the robot 100 to perform various navigational and cleaning behaviors, the controller 109 executes software stored on the memory storage element 144 to cause the robot 100 to perform by operating the various motors of the robot 100. The controller 109 operates the various motors of the robot 100 to cause the robot 100 to perform the behaviors.

Figure 4:
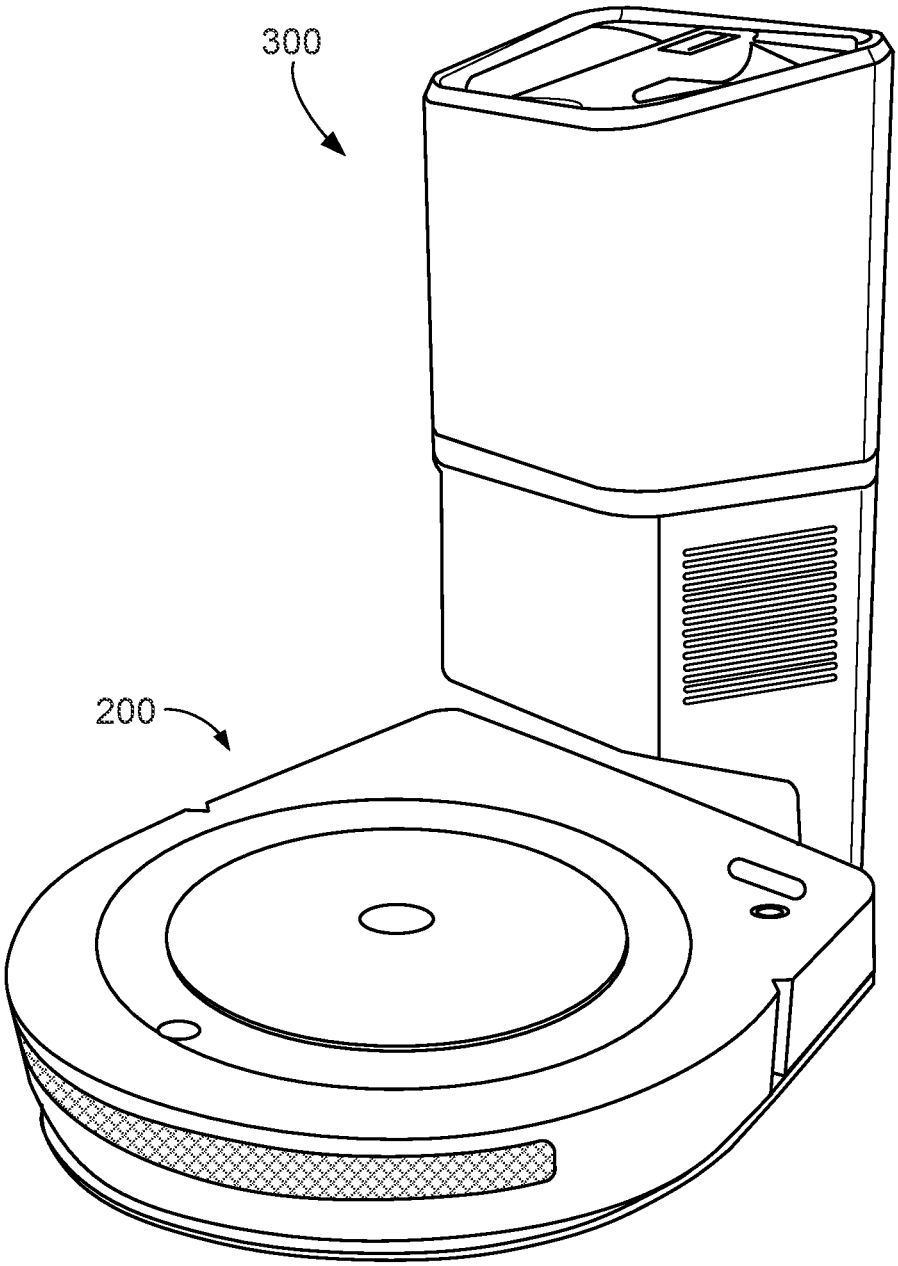
FIG. 4 is a perspective view of a cleaning system including an autonomous cleaning robot and a docking station for the autonomous cleaning robot.

In addition to including the robot 100, a robotic cleaning system can include a docking station that draws debris from the robot 100 and that charges a battery of the robot 100. FIG. 4 illustrates an example of a robotic cleaning system including the robot 100 and a docking station 300 for the robot 100. The robot 100 can return to the docking station when the debris bin 124 (shown in FIG. 2) is full so that the docking station 300 can perform an evacuation operation. In the evacuation operation, the docking station 300 generates an airflow to draw debris from the robot 100 into a receptacle within the docking station 300. While the robot 100 interfaces with the docking station 300, the debris bin 124 of the robot 100 is in pneumatic communication with an air mover of the docking station 300. In addition, in some implementations, the robot 100 is in electrical communication with the docking station 300 such that the docking station 300 can charge a battery of the robot 100 when the robot 100 interfaces with the docking station 300. Thus, while interfaced with the robot 100, the docking station 300 can simultaneously evacuate debris from the robot 100 and charge the battery of the robot 100.

While the docking station 300 is described as being capable of performing charging and evacuation operations, in some implementations, the docking station 300 can also perform an air purifying operation. In addition to being a charging station and an evacuation station, the docking station 300 can be an air purifier with systems that allow the docking station 300 to perform the air purifying operation. For example, the docking station 300 can include a fan system distinct from its vacuum system that enables it to perform the evacuation operation.

Figure 5:
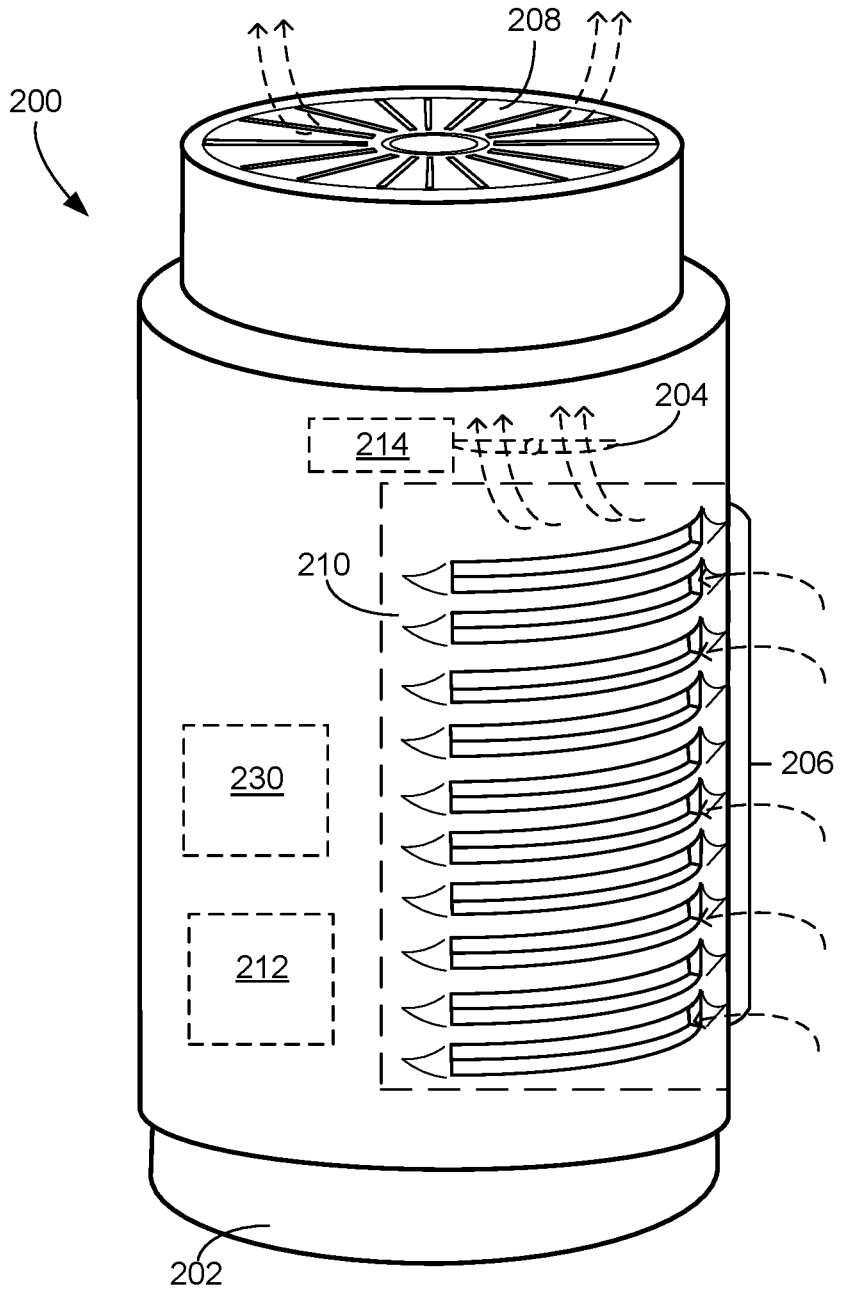
FIG. 5 is a side, perspective view of the air purifier of FIG. 1.

Air purifiers can vary in implementations. FIG. 5 illustrates an example of the air purifier 200. The air purifier 200 includes a base 202 to support the air purifier 200 above the floor surface 10 in the space. The air purifier 200 includes a fan system 204 for drawing air into an inlet 206 of the air purifier 200 and for expelling air out of an outlet 208 of the air purifier 200. The air purifier 200 includes a filter 210 within a housing of the air purifier 200 to capture particles in the air drawn into the air purifier by the fan system 204. The filter 210 can be replaceable by a user. The air purifier 200 includes a controller 212 configured to execute instructions to perform one or more operations including an operation to initiate a purifying operation of the air purifier 200. In the purifying operation, the air purifier 200 operates the fan system 204 to draw air into the air purifier 200 through the inlet 206, then through the filter 210, and then expels the filtered air through the outlet 208, thus filtering air in the space 20.

The air purifier 200 can be operated in accordance with one or more settings. For example, the air purifier 200 can have a fan speed setting with multiple levels of fan speed that can be automatically selected (e.g., by the controller 212 of the air purifier 200), a schedule for initiating and ceasing air purifying operations, a duration setting for setting a duration of an air purifying operation. For example, the air purifier 200 can operate the fan system 204 at multiple fan speeds, including a first fan speed and a second fan speed. In a low-power mode, the controller 212 operates the fan system 204 at the first fan speed, which is slower than the second fan speed. In a high-power mode, the controller 212 operates the fan system 204 at the second fan speed, which is faster than the first speed. In some implementations, the fan speed setting can include three or more different fan speeds at which the fan system 204 can be operated.

In some implementations, the air purifier 200 can include an air quality sensor 214 similar to the air quality sensor 148 of the robot 100. The air quality sensor 214 is configured to measure an air quality in a room in which the air purifier 200 is positioned. Measurements from the air quality sensor 214 can be used by the controller 212 for selecting one or more settings of the air purifier 200, e.g., a fan speed of the fan system 204. When the measurements from the air quality sensor 214 indicate poor air quality in the space 20, e.g., a threshold amount of contaminants in the space 20, the air purifier 200 can operate the fan system 204 at a higher fan speed, e.g., in the high-power mode.

Figure 6:
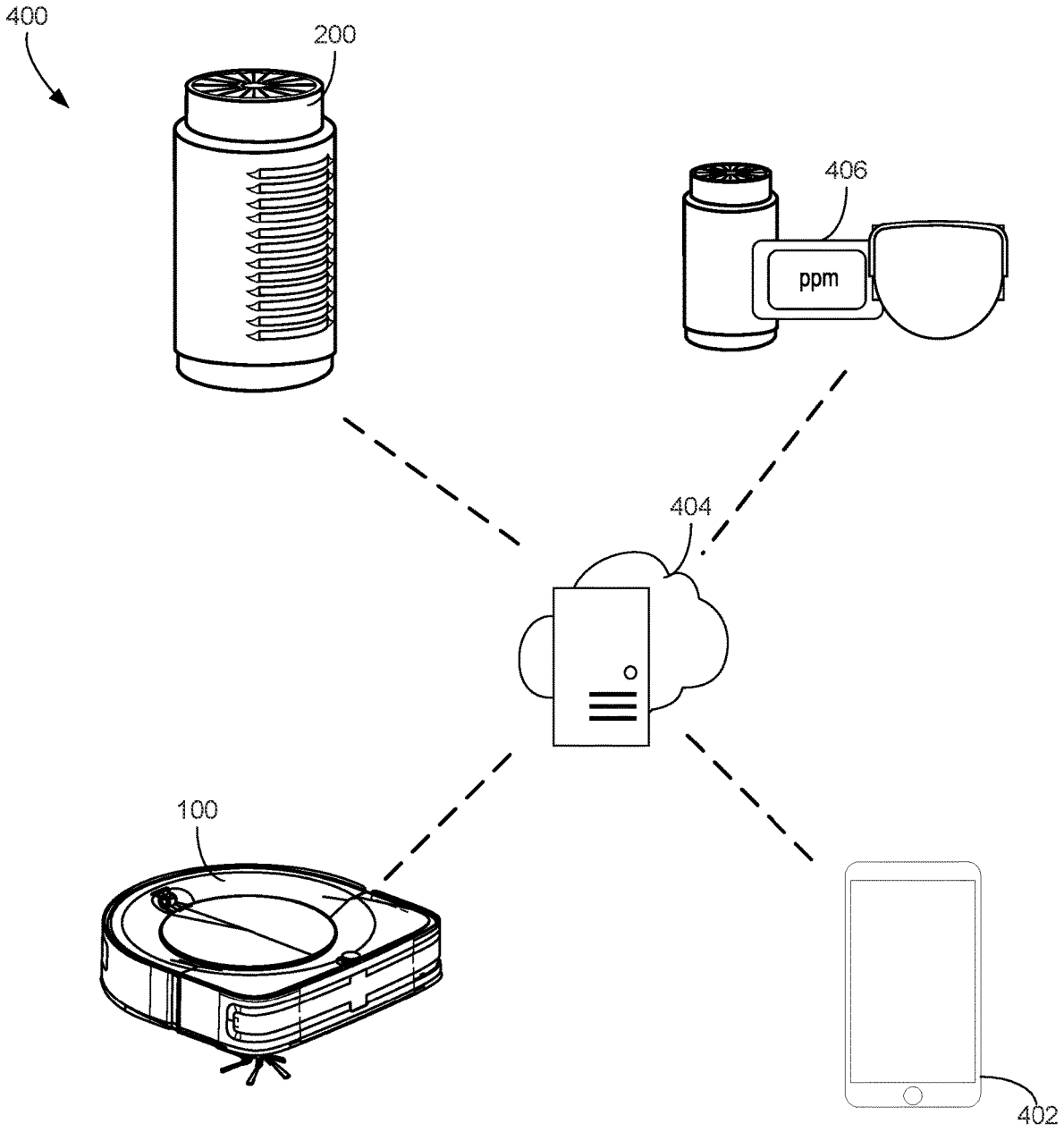
FIG. 6 illustrates a network including an autonomous cleaning robot and an air purifier, a remote server, and a mobile device.

While the air purifier 200 can be stationary, in some implementations, the air purifier 200 can include a drive system 230 that moves the air purifier 200 about the floor surface 10. In this regard, the air purifier 200 can be an autonomous air purifying robot. In some implementations, the robot 100 is capable of performing a purifying operation. The robot 100 includes a fan system similar to the fan system 204 of the air purifier 200. The fan system can be distinct from the vacuum system 119 of the robot 100. The robot 100 can perform the purifying operation using the fan system 204. And as discussed in this disclosure, in some implementations, the air purifier 200 can be a docking station for the robot 100, e.g., the docking station 300. Referring to FIG. 6, an example communication network 400 is shown. Nodes of the communication network 400 include the robot 100, a user computing device 402, the docking station 300, a remote computing system 404, and the air purifier 200. Using the communication network 400, the robot 100, the user computing device 402, the remote computing system 404, the docking station 300, and the air purifier 200 can communicate with one another to transmit data to one another and receive data from one another. In some implementations, the robot 100, the user computing device 402, the remote computing system 404, the docking station 300, and the air purifier 200 can communicate directly with one another or communicate with one another via an intermediate node, e.g., the remote computing system 404. Various types and combinations of wireless networks (e.g., Bluetooth, radio frequency, optical-based, etc.) and network architectures (e.g., mesh networks) may be employed by the communication network 400.

In some implementations, the communication network 400 can include other connected devices 406, e.g., additional air purifiers, autonomous cleaning robots, and/or air quality sensing devices. For example, the space 20 could include multiple air purifiers stationed in different regions in the space 20, or could include multiple autonomous cleaning robots to clean different regions in the space 20 or perform different types of cleaning operations in the space 20. In addition, the communication network 400 can include one or more air quality sensing devices separate from air quality sensors of the robot 100 and the air purifier 200. These air quality sensing devices can include air quality sensors similar to the air quality sensor 148 and the air quality sensor 214 described in this disclosure.

In some implementations, the user computing device 402 as shown in FIG. 4 is a remote device that can be linked to the remote computing system 404 and can enable the user to provide inputs on the user computing device 402. The user computing device 402 can include user input elements such as, for example, one or more of a touchscreen display, buttons, a microphone, a mouse, a keyboard, or other devices that respond to inputs provided by the user. The user computing device 402 alternatively or additionally includes immersive media (e.g., virtual reality) with which the user interacts to provide a user input. The user computing device 402, in these cases, is, for example, a virtual reality headset or a head-mounted display. The user can provide inputs corresponding to commands for the robot 100. In such cases, the user computing device 402 transmits a signal to the remote computing system 404 to cause the remote computing system 404 to transmit a command signal to the robot 100. In some implementations, the user computing device 402 can present augmented reality images. In some implementations, the user computing device 402 is a smartphone, a laptop computer, a tablet computing device, or other type of mobile device.

In some implementations, the communication network 400 can include additional nodes. For example, nodes of the communication network 400 can include additional robots. Alternatively or additionally, nodes of the communication network 400 can include network-connected devices. In some implementations, a network-connected device can generate information about the space 20. The network-connected device can include one or more sensors to detect features in the space 20, such as an acoustic sensor, an image capture system, or other type of sensor that generates signals from which features can be extracted. Network-connected devices can include other air purifiers, other autonomous cleaning robots, air quality sensing devices, home cameras, smart sensors, and the like.

In the communication network 400 depicted in FIG. 4 and in other implementations of the communication network 400, the wireless links may utilize various communication schemes, protocols, etc., such as, for example, Bluetooth classes, Wi-Fi, Bluetooth-low-energy, also known as BLE, 802.15.4, Worldwide Interoperability for Microwave Access (WiMAX), an infrared channel or satellite band. In some cases, the wireless links include any cellular network standards used to communicate among mobile devices, including, but not limited to, standards that qualify as 1G, 2G, 3G, or 4G. The network standards, if utilized, qualify as, for example, one or more generations of mobile telecommunication standards by fulfilling a specification or standards such as the specifications maintained by International Telecommunication Union. The 3G standards, if utilized, correspond to, for example, the International Mobile Telecommunications-2000 (IMT-2000) specification, and the 4G standards may correspond to the International Mobile Telecommunications Advanced (IMT-Advanced) specification. Examples of cellular network standards include AMPS, GSM, GPRS, UMTS, LTE, LTE Advanced, Mobile WiMAX, and WiMAX-Advanced. Cellular network standards may use various channel access methods, e.g., FDMA, TDMA, CDMA, or SDMA.

Figure 7:
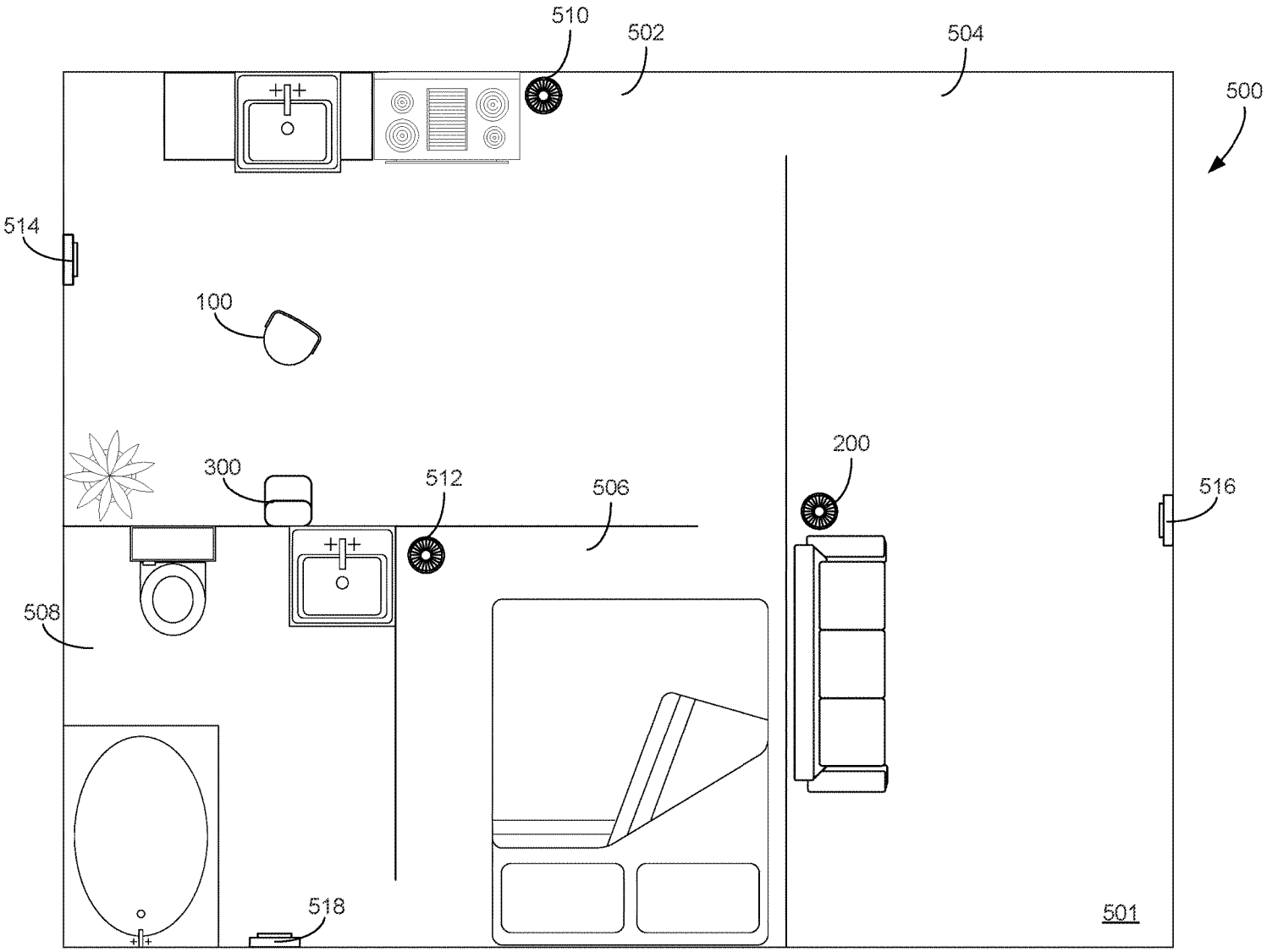
FIG. 7 is a top view of a space in which an autonomous cleaning robot and an air purifier operate.

Devices in the communication network 400, in particular, the robot 100, the air purifier 200, and the user computing device 402, can be controlled in certain manners in accordance with processes described herein to define and establish behavior control zones. FIG. 7 illustrates an example of a space 500 where the robot 100 and the air purifier 200 can operate, and FIG. 8 illustrates an example process 600 for controlling operations of the robot 100, the air purifier 200, the user computing device 402 (shown in FIG. 6), or a combination of these devices.

FIG. 7 provides a top view of example of the space 500 within which the robot 100 and the air purifier 200 operates. The robot 100 travels about a floor surface 501 of the space 500 to clean the floor surface 501. The space 500 includes a first room 502, a second room 504, a third room 506, and a fourth room 508. In addition to the robot 100 and the air purifier 200, the space 500 can include other devices, including the docking station 300 for the robot 100. Other devices in the example of the space 500 shown in FIG. 7 include air purifiers 510, 512 and air quality sensing devices 514, 516, 518.

The process 600 is described in connection with the robot 100, the air purifier 200, a computing system 650, and the user computing device 402 described with respect to FIG. 6. The computing system 650 can be a computing system of the robot 100, the air purifier 200, the user computing device 402, the remote computing system 404, or another computing system. While some operations of these processes may be described as being performed by the robot 100, by the air purifier 200, by a user, by a computing device, or by another actor, these operations may, in some implementations, be performed by actors other than those described. For example, an operation performed by the robot 100 can be, in some implementations, performed by the remote computing system 404 or by another computing device (or devices). In other examples, an operation performed by the user can be performed by a computing device. In some implementations, the remote computing system 404 does not perform any operations. Rather, other computing devices perform the operations described as being performed by the remote computing system 404, and these computing devices can be in direct (or indirect) communication with one another and the robot 100. And in some implementations, the robot 100 can perform, in addition to the operations described as being performed by the robot 100, the operations described as being performed by the remote computing system 404 or the user computing device 402. Other variations are possible. Furthermore, while the methods, processes, and operations described herein are described as including certain operations or sub-operations, in other implementations, one or more of these operations or sub-operations may be omitted, or additional operations or sub-operations may be added.

Figure 8:
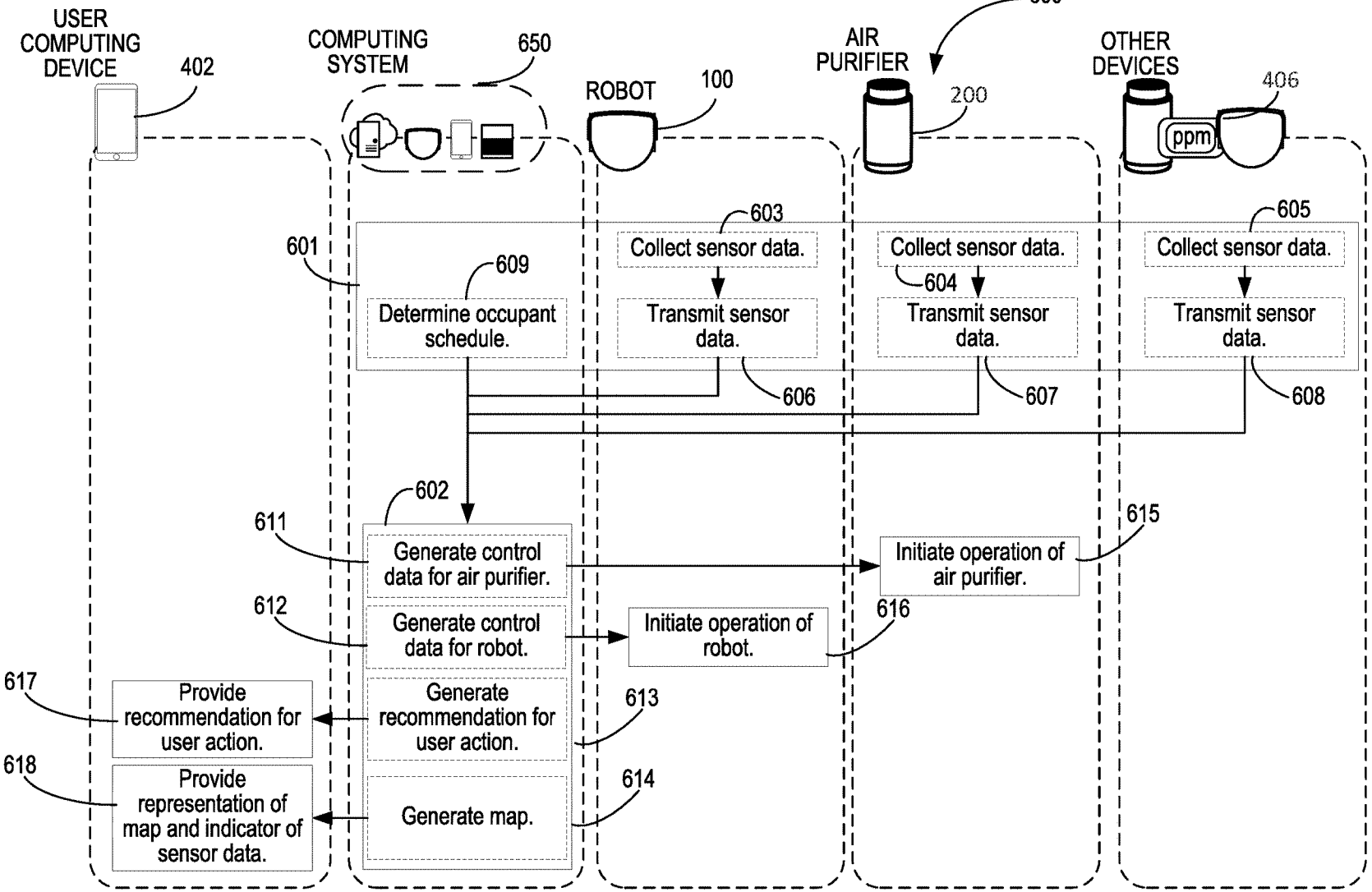
FIG. 8 is a flowchart of a process for controlling an operation of an air purifier.

FIG. 8 is a flowchart of the process 600 for controlling an operation of the air purifier 200. The process 600 includes operations 601-618. The process 600 includes a data collection operation, e.g., the operation 601, a data processing operation, e.g., the operation 602, and an output operation to control a device or provide information to a user, e.g., the operations 615-618. At the data collection operation 601, one or more operations in which data about the space 500 is generated and/or transmitted occurs. Then, at the data processing operation 602, the data about the space 500 is processed to generate data that can then in turn be used to provide an output to the robot 100, the air purifier 200, and/or the user computing device 402 at the operations 615-618.

The operation 601 can involve collection of sensor data and other information relevant to operations of the robot 100 and the air purifier 200. In the examples illustrated in FIG. 8, the operation 601 is shown to include the operations 603-610. In implementations, one or more these operations can occur depending on how the data about the space 500 are used to control the robot 100, to control the air purifier 200, to provide recommendations to the user, or to provide the user with information about the space 500.

At the operation 603, the robot 100 collects sensor data. The sensor data can be collected by a sensor of the sensor system of the robot 100. In this regard, the sensor data can be floor type sensor data collected by the floor type sensor 149, air quality sensor data collected by the air quality sensor 148, debris sensor data collected by the debris detection sensor 147, or sensor data collected by other sensors of the sensor system of the robot 100. In addition to collecting the sensor data, the robot 100 can collect location data as the robot 100 travels about the space 500 and collects the sensor data. The sensor data can be location-referenced, thereby allowing the sensor data and the location data to be used to produce a map overlaid with information relating to the sensor data.

In some implementations, at the operation 603, the sensor data can be collected during an operation or mission that varies. These sensor data can be collected during a cleaning mission of the robot 100 in which the robot 100 travels about the floor surface 501 and cleans the floor surface 501. In some implementations, these sensor data can be collected during an operation or mission in which the robot 100 does not clean the floor surface 501 or does not activate the vacuum system 119 of the robot 100 during the sensing mission. In this regard, the vacuum system 119 of the robot 100 does not disturb the airflow in the space 500 as the robot 100 performs the sensing mission, and thus if the robot 100 is collecting air quality data, the vacuum system 119 does not disturb what the air quality sensor of the robot 100. For example, the operation or mission can be a sensing mission in which the robot 100 travels about the floor surface 501 with the purpose of collecting the sensor data in areas of the space 500 that can be traversed by the robot 100, e.g., traversable areas. During the sensing mission, the robot 100 can collect the sensor data in all traversable areas or a subset of the traversable areas. In some examples of the sensing mission, referring to FIG. 7, the robot 100 can travel from the docking station 300 to the second room 504 in which the air purifier 200 is located to collect the sensor data in the second room 504. In some implementations, during the sensing mission, the robot 100 only travels through a portion of the target room or region. For instance, the robot 100 can travel to specific locations within the room or region and then the sensor data collected at those locations can be used to compute an average value from the sensor data. If the sensor data is air quality sensor data, the average value can represent an average detected air quality within the target room or region.

Referring back to FIG. 8, at the operation 604, the air purifier 200 collects sensor data. The sensor data can be collected by the air quality sensor 214 of the air purifier 200 or other sensor of the air purifier 200.

At the operation 605, the other sensing devices 406 in the space 500 can be used to collect sensor data. For example, the space 500 can include one or more air purifiers or one or more air quality sensors. The other sensing devices 406 can include, for example, as shown in FIG. 7, the air purifier 510, 512 and the air quality sensing devices 514, 516, 518. At the operations 606, 607, 608, the sensor data collected at the operations 603, 604, 605 are transmitted to the computing system 650. For example, the robot 100, the air purifier 200, and/or the other sensing devices 406 can include wireless transceivers that allow these devices to transmit and/or send sensor data collected by them. In some implementations of the process 600, a device can perform the operation 602 to process the sensor data on the computing system of the device, and does not transmit the sensor data to an external device. For example, the robot 100 can collect the sensor data and can perform at least part of the operation 602 on the controller of the robot 100. Similarly, in some implementations, the air purifier 200 can collect the sensor data and can perform at least part of the operation 602 on the controller of the air purifier 200.

At the operation 609, a schedule of an occupant of the space 500 is determined. The computing system 650 can receive data indicative of an occupant schedule indicating a time period in which an occupant is absent from the space 500 or from a room in the space 500. In some implementations, the schedule can indicate whether the occupant is in the space 500 or are not in the space 500. For example, if the space 500 is a home space, the schedule can indicate a schedule of when the occupant is at home and when the occupants is not at home. In some implementations, the space 500 can have multiple occupants, the schedule can indicate a schedule of each of the occupants. For example, the occupants can include a human occupant, a pet occupant, a combination of human occupants and pet occupants, and the like.

In some implementations, at the operation 609, the occupant schedule can be determined based on location data generated by a mobile device carried by the occupant, e.g., the user computing device 402. For example, the user computing device 402 can include one or more systems that would allow a location of the user computing device 402 to be determined, such as a near-field communication transceiver, a global positioning system (GPS) sensor, a WiFi transceiver, or other system for determining locations of mobile devices.

In some implementations, at the operation 609, the schedule can be user-selected. For example, a human occupant can provide information indicative of the schedule using the user computing device 402. In some implementations, the human occupant can manually provide information indicative of times that the human occupant does not expect to be in the space 500 or expects to be in the space 500. In some implementations, the human occupant can provide input to the user computing device 402 indicating that they have left the space 500 and can provide another input to the user computing device 402 indicating that they have returned to the space 500. Based on one or more of these inputs, the user computing device 402 can determine the schedule of the occupant. In other implementations, the schedule can be determined based on sensors on devices in the space 500. The space 500 can include one or more image capture devices that can capture imagery usable to determine whether the occupant is in the space. In some implementations, the robot 100 can determine whether an occupant is present in the space 500 using the image capture device 140 of the robot 100 (shown in FIG. 3B).

At the operation 609, in some implementations, the schedule can indicate a period of time that an occupant is located within a specific region within the space 500. Referring to FIG. 7, a region can correspond to one of the rooms 502, 504, 506, 508, or a sub-region within one or more of the rooms 502, 504, 506, 508. In some implementations, a region can be associated with one or more objects in the space 500, e.g., a table, a couch, a cabinet, or other object in the space 500. For example, if an occupant uses an object during a particular time period, such as a couch to watch television, the occupant schedule can indicate that the occupant is present in a region associated with the couch during a particular time period. As discussed below, the information represented in the schedule can be used to control activities of the robot 100 and the air purifier 200.

While the operation 601 is described with respect to specific sub-operations, e.g., the operations 603-609, other data can be used during the data collection operation 601. In some implementations, the computing system 650 receives data indicative of an environmental condition. The data indicative of the environmental condition can be received from a remote server or database that compiles or otherwise transmits information representing environmental conditions. The environmental condition can be a seasonal condition, such as, for example, a weather pattern (e.g., rain, snow, wind, hurricane, tornado) or a pollen condition. The environmental condition can be an acute environmental condition, such as, for example, a wildfire, construction activity, traffic activity, or other activity in the environment that can cause an increase in airborne contaminants. The environmental condition can be a current environmental condition, e.g., detected by an outdoor air quality sensor, or a predicted environmental condition.

In some implementations, during the data collection operation 601, scheduling information for the air purifier 200 and/or schedule information for the air purifier 200 can be determined. For instance, a user may select a schedule for cleaning missions of the robot 100 or may select a schedule for filtering operations of the air purifier 200. As discussed in this disclosure, this information can be used at the processing operation 602.

At the operation 602, after data are is collected and/or generated at the operation 601, these data can be processed. Then, some output can be provided to the robot 100, the air purifier 200, and/or the user computing device 402 at the operations 615-618. In the examples illustrated in FIG. 8, the operation 602 includes the operations 611-614. The output of these operations can cause one or more of the operations 615-618 to occur. The data that is processed at the operation 602 can depend on the output, e.g., which of the operations 615-618 occur. Examples of each of the specific operations of the process 600 are described below.

At the operations 611 and 615, control data for the air purifier 200 is generated and used to initiate an operation of the air purifier 200. The control data can be generated based on the sensor data collected at the operation 601.

In some implementations, at the operations 611 and 615, the control data is generated to initiate the operation of the air purifier 200 when the robot 100 travels to a particular location in the space 500. The location of the robot 100 can trigger the operation of the air purifier 200. The control data can be generated, for example, based on data indicative of a location of the robot 100 while the robot 100 performs a cleaning mission to clean the space 500. The computing system 650 receives, e.g., wirelessly from the robot 100, these data to determine a location of the robot 100. The data indicative of the location of the robot 100 can be generated by one or more sensors of the sensor system of the robot 100, e.g., odometry sensor, the image capture device 140, the proximity sensors 136*a*, 136*b*, the bumper 138, the cliff sensors 134, or other sensors of the sensor system of the robot 100. The computing system 650 can determine that the location of the robot 100 is in a region, e.g., a room, an area associated with an object (e.g., a rug, a couch, or other object in the space 500), or other region, in the space within which the air purifier 200 is located. In the example depicted in FIG. 7, based on the data indicative of the location of the robot 100, the computer system 650 can determine that the location of the robot 100 is in a region in which the air purifier 200 is located, e.g., the room 504. The region in which the air purifier 200 is located can be determined using a sensor on the air purifier 200, from manual selection by the user, through detection by the robot 100, or through other appropriate mechanisms. For example, if the location is determined by manual selection by the user, the user can operate the user computing device 402 to select the location of the air purifier 200 on a representation of a map generated using sensor data from the robot 100. The user can select the room within which the air purifier 200 is located or select a region within which the air purifier 200 is located. In some examples, the user can provide a geometry of the region within which the air purifier 200 is located, e.g., by drawing the geometry using a touchscreen input device of the user computing device 402.

At the operation 615, in response to determining that the location of the robot 100 is in the region in which the air purifier 200 is located, the computing system 650 causes the operation of the air purifier 200 to be initiated. For example, the computing system 650 can transmit a signal, e.g., a wireless signal, to the air purifier 200 to cause the air purifier 200 to initiate the operation at the operation 615. The cleaning mission of the robot 100 is coordinated with the air purifying operation of the air purifier 200 such that the floor and the air in the vicinity of the region can be cleaned simultaneously. This can have synergistic effects, as the cleaning system 116 of the robot 100 can cause air in the region to circulate and thus can improve the efficacy of the purifying operation of the air purifier 200. In examples in which the robot 100 includes the vacuum system 119, the vacuum system 119 can exhaust particulate matter into the air in the space 500 as the robot 100 cleans the floor surface 501. The simultaneous operations of the robot 100 and the air purifier 200 when the robot 100 and the air purifier 200 are collocated can allow the air purifier 200 to filter from the air at least some of the particulate matter exhausted by the robot 100 as the robot 100 cleans the floor surface 501.

At the operation 615, the specific operation initiated by the air purifier 200 can vary in implementations. In some examples, the specific operation corresponds to an adjustment of one or more settings of the air purifier 200. As discussed in this disclosure, the one or more settings can include an activation state of the air purifier 200 (e.g., the "on" or "off" state), a fan speed setting, a schedule, a duration setting, or other setting of the air purifier 200 or of a specific system of the air purifier 200. In some examples, the specific operation of the air purifier 200 corresponds to an activation of the air purifier 200 in which the air purifier 200 is switched from an "off" state to an "on" state. In some examples, the specific operation of the air purifier 200 corresponds to a selection of a fan speed setting. The air purifier 200 can initiate an operation to initiate a high-power mode of the fan system 204 in response to the location of the robot 100 being in the region in which the air purifier 200 is located. In further examples, the air purifier 200 can be activated and can have a duration setting selected based on a size of the region. In some implementations, in response to the robot 100 leaving the region in which the air purifier 200 is located, the air purifier 200 is deactivated or the one or more settings are changed to their states before the robot 100 entered into the region.

In some implementations, at the operation 615, the operation to change the one or more settings of the air purifier 200 involves changing multiple settings. For example, the fan speed setting can be set to a higher setting, e.g., one or more levels higher or the highest setting, and the duration setting can be set. In this regard, the air purifier 200 would operate at the higher fan speed setting for a selected duration of time. In some examples, the user can select the specific settings of the air purifier 200 that are used when the robot 100 enters the region in which the air purifier 200 is located.

At the operations 611 and 615, while information about a location of the robot 100 and/or a location of the air purifier 200 can be used to control the operations of the air purifier 200, in implementations, other information, alone or in combination with the location information, can be used for controlling the operation of the air purifier 200 at the operation 615. The different sensors of the sensor system of the robot 100 can be used to provide information relevant to air quality in the space 500.

In some implementations, at the operations 611, 615, a floor type is used to generate control data to initiate an operation of the air purifier 200. The floor type sensor 149 of the robot 100 can detect a particular floor type in a region and generate, at the operation 603, sensor data indicative of the floor type in the region in the space 500, and these sensor data can be processed to generate control data for the air purifier 200 and thereby cause the air purifier 200 to initiate an operation based on the floor type. The control data can be used to control an air purifier that is in a region having a particular floor type. For example, certain floor types, such as carpeting, may entrain particulate matter more easily than other floor types, such as hardwood or tile. By way of example, the portion of the floor surface 501 in the second room 504 could be carpet, and the portion of the floor surface 501 in the first room 502 could be a hard surface such as hardwood or tile. The sensor data collected by the robot 100 could be indicative of these floor types. Because the carpet in the second room 504 could potentially result in greater dust and other particulate matter being entrained in the carpet, which can be dispersed in the air through vacuuming or other mechanical perturbations of the carpet, the computing system 650 can generate control data to cause an air purifier in the second room 504, e.g., the air purifier 200, to activate at a higher frequency. In particular, at the operation 611, the computing system 650 can determine a floor type of a region based on the sensor data collected by the robot 100, determine that an air purifier is located in the region, and generate control data for the air purifier, e.g., the air purifier 200, to cause the air purifier 200 to initiate an operation. In response to the detected floor type, the operation of the air purifier 200 initiated at the operation 615 can involve changing one or more settings of the air purifier 200, e.g., a frequency setting, a duration setting, a fan speed setting, or other appropriate setting that would allow the air purifier 200 to more easily capture contaminants in the region having the detected floor type.

In some implementations, at the operations 611, 615, an air quality measurement is used to generate control data to initiate an operation of the air purifier 200. The air quality sensor 148 of the robot 100 can generate data indicative of the air quality in the space 500, and then these air quality sensor data can be used to generate control data to initiate the operation of the air purifier 200. If the sensed air quality is above a threshold value, control data for the air purifier 200 can be generated at the operation 611 and then can be used to cause the air purifier 200 to initiate the operation at the operation 615. As discussed in this disclosure, if the robot 100 generates the data indicative of the air quality, in some implementations, the robot 100 can initiate a sensing mission to generate these data.

In some implementations, at the operations 611, 615, data indicative of debris detected on a floor surface is used to generate control data to initiate an operation of the air purifier 200. The debris detection sensor 147 of the robot 100 can generate data indicative of debris on the floor surface 501 in the space 500, and the debris sensor data can be used to generate control data to initiate the operation of the air purifier 200. The debris sensor data can be indicative of one or more attributes of the debris that further indicate poor air quality in the space 500. For example, detection of a large amount of small particulate matter on the floor surface 501 in the space 500 can indicate the presence of a large amount of particulate matter in the air. The control data can be generated to cause the air purifier 200 to change one or more settings of the air purifier 200, e.g., to operate more frequently or at higher fan speeds.

In some implementations, at the operations 611, 615, the sensor data generated by the robot 100 can be used in combination with other data generated by sensors in the space 500. For example, sensor data collected by the air quality sensing devices 514, 516, 518 and/or sensor data collected by the air purifiers 510, 512 can be used to generate the control data for the air purifier 200. In particular, air quality sensors of these devices can be used to generate sensor data indicative of air quality at different locations in the space 500. The computing system 650 can generate the control data at the operation 611 based on the sensor data collected by the robot 100 and the sensor data collected by one or more of these other devices in the space 500. The computing system 650 can compute a value indicative of the air quality, and the value can correspond to an average of one or more values generated by the air quality sensor 148 of the robot 100 and one or more values generated by other devices in the space 500.

In some implementations, at the operations 611 and 615, the sensor data generated by the robot 100 can be used in combination with data collected by the air quality sensor 214 of the air purifier 200. For example, a value of the air quality represented by the sensor data collected by the robot 100 and a value of the air quality represented by the sensor data collected by the air quality sensor 214 of the air purifier 200 can be averaged, and the control data is generated based on the average value. In some implementations, the value of the air quality is represented by a rate of change of the air quality value in the space 500. The air quality value can be compared to a threshold value to determine whether to generate the control data to initiate the operation of the air purifier 200.

In some implementations, at the operations 611 and 615, information about an occupant schedule is used to generate control data to initiate an operation of the air purifier 200. For example, the occupant schedule determined at the operation 609 can be used so that the operation of the air purifier 200 is initiated only when occupants are present or absent from a region in the space 500. If an occupant is noise-sensitive, for example, the air purifier 200 can be controlled so that it is deactivated when the occupant is present in the region. The control data can be generated and the operation of the air purifier 200 can be initiated in response to the absence of the occupant from the region or from the space 500. In some cases, the occupant schedule indicates a time period in which an occupant is absent from the region or from the space 500. The operation of the air purifier 200 can be initiated during this time period. In contrast, in some cases, the occupant may prefer that the air purifier 200 is activated when the occupant is present to improve the quality of the air breathed by the occupant. In this regard, the control data can be generated and the operation of the air purifier 200 can be initiated in response to the presence of the occupant in the region or in the space 500. The occupant schedule can indicate a time period in which an occupant is present in the region or in the space 500. The operation of the air purifier 200 can be initiated during this time period.

In some implementations, at the operations 611 and 615, information about an environmental condition can be used to generate control data to initiate an operation of the air purifier 200. In examples in which the environmental condition corresponds to a current environmental condition, the control data can be used to initiate an operation of the air purifier 200 at a current time. In examples in which the environmental condition corresponds to a forecasted or predicted environmental condition, the control data can be used to generate a schedule for initiating the operation of the air purifier 200 at a future, scheduled time.

In some implementations, at the operations 611 and 615, the information used to generate the control data to initiate the operation of the air purifier 200 is associated with a location or a region in the space 500. In this regard, the information collected at the operation 601 can be location-associated sensor data. The air purifier 200 that is controlled using the control data can be within a certain distance from the location or the region, or can be in the region. In some cases, the region corresponds to the space 500 itself. For example, if the sensor data used to generate the control data represents an air quality value, the air quality value can be an air quality value detected at a particular location in the space 500, at a particular region in the space, or can be an air quality detected any location in the space 500. In some implementations, the air purifier 200 initiates the operation if the air quality value exceeds the threshold value at a location within a distance from the air purifier 200, e.g., within 1, 2, or 3 meters. In some implementations, the air purifier 200 initiates the operation if the air quality value exceeds the threshold value at a region in which the air purifier 200 is located, e.g., in a room in which the air purifier 200 is located, in a sub-region of a room in which the air purifier 200 is located, or in some other region in which the air purifier 200 is located. In some implementations, the air purifier 200 initiates the operation if the air quality value exceeds the threshold value in the space 500. In such implementations, if the space 500 includes multiple air purifiers, operations of each of the air purifiers can be initiated in response to the air quality value exceeding the threshold value.

The air quality value can correspond to a single air quality measurement or can be computed from one or more air quality measurements. For instance, the air quality value can an average air quality value computed from two or more air quality measurements at different locations in the region or in the space.

At the operations 612 and 616, control data for the robot 100 is generated and used to initiate an operation of the robot 100. The control data can be generated based on the sensor data collected at the operation 601.

In some implementations, at the operations 612 and 616, information representing air quality in the space 500 is used to generate the control data for initiating the operation of the robot 100. For example, the air quality sensor 214 of the air purifier 200 or other air quality sensing devices in the space 500 can generate air quality sensor data that in turn can be used to generate control data for the robot 100. The air quality sensor data can indicate higher amounts of airborne contaminants in a region within the space 500, which can suggest higher amounts of contaminants could be present on the floor surface 501 in the region. The control data can be generated to cause the robot 100 to perform a cleaning operation within the region in the space 500 to clean at least some of the contaminants that are present on the floor surface 501. The robot 100 can be controlled to immediately travel to the region, or in some implementations, a schedule for the cleaning operation of the robot 100 can be generated so that the robot 100 cleans the region at a later time. In examples in which the air quality information is used to control the robot 100, the sensor data can be collected by the air purifier 200, by one or more other air purifiers in the space 500, e.g., the air purifiers 510, 512, or by one or more air quality sensing devices in the space 500, e.g., the air quality sensing devices 514, 516, 518. As discussed with respect to control of the air purifier 200, the control data generated for the robot 100 can be generated based on a single air quality value or multiple air quality values, and the air quality value can represent an air quality detected a particular time or a rate of change of the air quality.

In some implementations, at the operations 612 and 616, information representing the occupant schedule is used to generate the control data for initiating the operation of the robot 100. In particular, the operation of the robot 100 can be initiated such that the operation of the robot 100 is coordinated with the occupant schedule. For example, the robot 100 can perform a cleaning mission during a time period in which the occupants are present or absent from the space 500. The occupant schedule can be determined using the methods discussed in this disclosure.

In some implementations, at the operations 612 and 616, information representing an environmental condition is used to generate the control data for initiating the operation of the robot 100. For example, based on information representing a current environmental condition, the computing system 650 can generate the control data to initiate the operation of the robot 100 so that the robot 100 can clean contaminants from the floor surface 501 in part caused by the current environmental condition. The information can be representing a future or predicted environmental condition, and the computing system 650 can generate the control data to cause the robot 100 to initiate the operation at a scheduled time. Examples of environmental conditions are discussed elsewhere in this disclosure.

The operation of the robot 100 that is initiated at the operation 616 can vary in implementations. The operation of the robot 100 can involve changing one or more settings of the robot 100 or a system of the robot 100. For example, the operation can involve changing one or more settings of the cleaning system 116 of the robot 100, e.g., a rotational speed of the rotatable members 118 or a fan speed of the vacuum system 119. The operation can involve changing one or more settings of a movement speed or a movement pattern of the robot 100. If air quality data is used to generate the control data, the robot 100 can be operated in a high-power mode in which the rotational speed of the rotatable members, the fan speed of the vacuum system 119, or both the rotational speed and the fan speed are increased so that the robot 100 can more easily clean contaminants on the floor surface in a region. Alternatively or additionally, the control data can cause the robot 100 to move at a reduced movement speed or can cause the robot 100 to move in a movement pattern to cover a particular region where poor air quality was detected. In some implementations, the operation involves causing the robot 100 to initiate one or more cleaning missions in accordance with a schedule. In examples in which the information representing the occupant schedule and/or the information representing the environmental condition are used to generate the control data, a schedule for the robot 100 can be generated so that the robot 100 initiates the operation at a scheduled time. In some implementations, the operation involves causing the robot 100 to clean the rooms in the space 500 in a particular order. In generating the control data, the computing system 650 can generate priorities for cleaning the rooms in the space 500 based on air quality values in the particular rooms. For example, the priorities can be set such that the robot 100 cleans the rooms in an order that prioritizes cleaning of the rooms with the worst air quality.

The operations 611, 612 for generating the control data to initiate the operation of the air purifier 200 at the operation 615 and for generating the control data to initiate the operation of the robot 100 at the operation 616 can involve coordination of schedules of the robot 100 and the air purifier 200. In implementations in which scheduling information for the robot 100 and/or scheduling information for the air purifier 200 are collected during the data collection operation 601, the computing system 650 can synchronize the schedule of the robot 100 with the schedule for the air purifier 200. For example, if a user selects a schedule for the robot 100 to perform a cleaning mission, the computing system 650 can establish a schedule for the air purifier 200 based on the schedule for the robot 100. The cleaning mission of the robot 100 can occur at the same time as the filtering operation of the air purifier 200. In some implementations, the cleaning mission and the filtering operation can occur sequentially. For example, the robot 100 can initiate the cleaning mission and perform the cleaning mission during a first time period, and the air purifier 200 can initiate a filtering operation in response to the cleaning mission being complete. In some implementations, the coordination of the operations of the air purifier 200 and the robot 100 occurs as result of the control data generated at the operation 611 and the control data generated at the operation 612 being generated based on the same information collected at the operation 601. For example, the control data for the air purifier 200 and the robot 100 can be generated based on information representing an environmental condition or based on information representing an occupant schedule The operations 611, 612, 615, 616 can involve automatic control of the air purifier 200 and/or the robot 100 depending on whether an automatic control feature is activated by a user, e.g., using the user computing device 402. For example, the user can operate the user computing device 402 to select whether automatic control of the air purifier 200, automatic control of the robot 100, or both automatic control of the air purifier 200 and the robot 100 should occur.

Figure 9A:
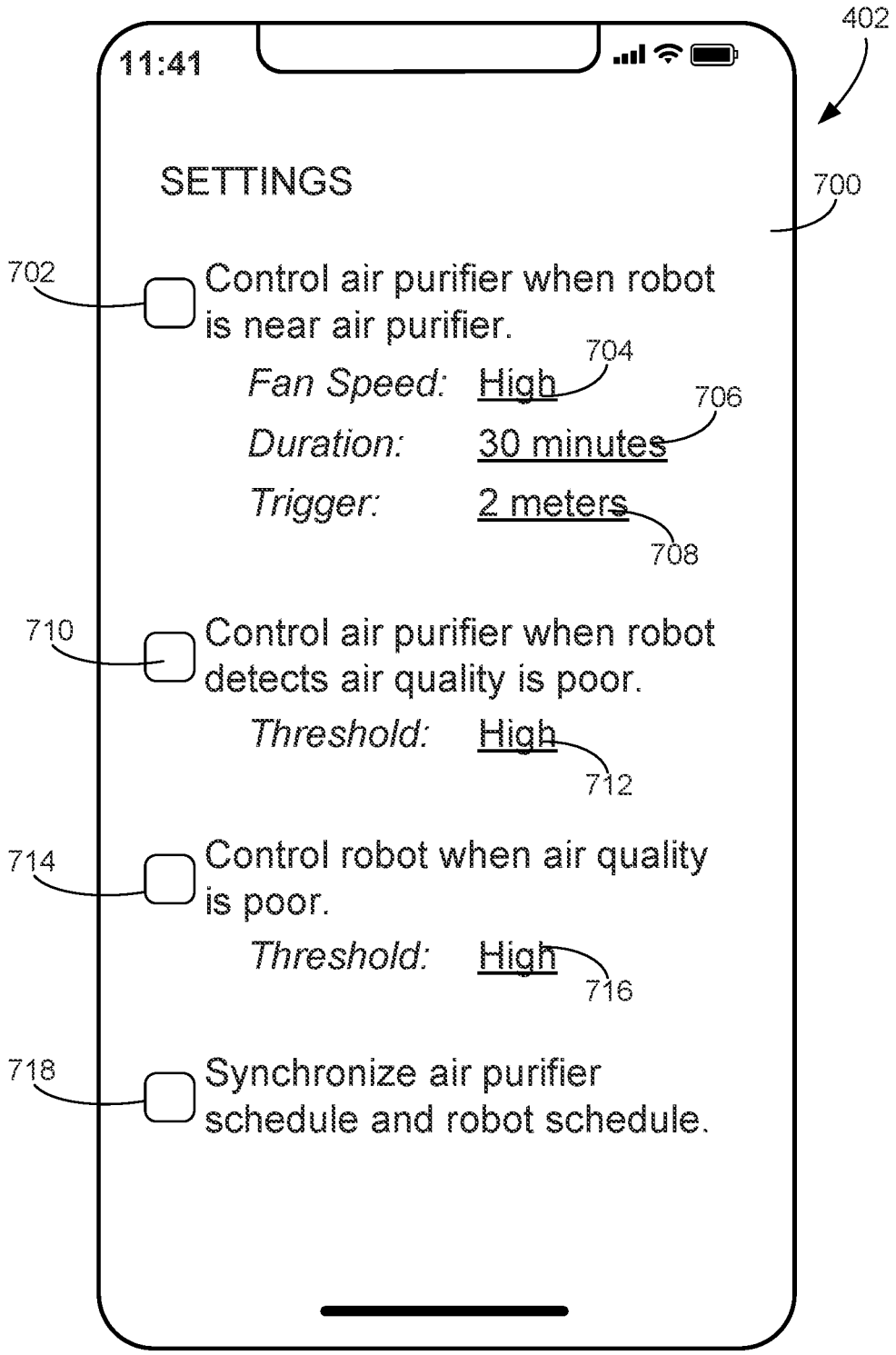
FIGS. 9A-9E are example screenshots of a user interface.

For example, referring to FIG. 9A, a display 700 of the user computing device 402 can present a list of settings for coordination of activities of the air purifier 200 and the robot 100. The display 700 can present one or more affordances for controlling an operation of the air purifier 200. An affordance 702 can be selected to coordinate the operation of the air purifier 200 with the location of the robot 100 during a mission of the robot 100. In particular, the affordance 702 can be selected by the user to activate the location-based control of the air purifier 200. In this example, the user can select different settings for this control of the air purifier 200. The display 700 can present an affordance 704 to allow the user to select a fan speed for a fan speed setting of the air purifier 200, an affordance 706 to allow the user to select a duration for a duration setting of the air purifier 200, and an affordance 708 to allow the user to select a triggering event that would cause the air purifier 200 to initiate the operation that would change the fan speed setting to the selected fan speed and change the duration setting to the selected duration. In the example shown in FIG. 9A, the user selects the fan speed setting to be "high," the duration setting to be "30 minutes," and the trigger setting to be "2 meters." Other selectable fan speeds of the fan speed setting could include "low," "medium," or another appropriate fan speed. Other selectable duration of the duration setting could be, for example, any value between 1 to 240 minutes. Other selectable triggers for the trigger setting could be a same room trigger in which the operation of the air purifier 200 is triggered when the robot 100 and the air purifier 200 are in the same room, a same region trigger in which the operation of the air purifier 200 is triggered when the robot 100 and the air purifier 200 are in the same region, a distance trigger in which the operation of the air purifier 200 is triggered when the robot 100 and the air purifier 200 are within a certain distance from one another (e.g., no more than 2 to 10 meters), or another location-based trigger.

The settings represented by the affordances 704, 706, 708 could be applicable to other implementations of coordination of air purifier activities. For example, in examples in which sensor data indicative of floor type, air quality, debris or in which information representing an occupant schedule or seasonal condition is used to generate the control data to cause the air purifier 200 to initiate the operation, the display 700 can present an affordance to activate this automatic control based on sensor data and/or information, and can present further affordances for selecting the precise parameters for operating the air purifier based on the sensor data and/or information. As shown in FIG. 9A, for example, the display 700 can present an affordance 710 that can be selected by the user to activate the air quality-based control of the air purifier 200. When the affordance 710 is selected, the display 700 can also present an affordance 712 for selecting the threshold value at which the air purifier 200 is activated. For example, the user could select "low," "medium," and "high," and each of these can correspond to a particular threshold value for triggering the operation of the air purifier 200. These thresholds can correspond to threshold AQI values. The "low" setting could correspond to a threshold AQI value between 5 and 25, the "medium" setting could correspond to a threshold AQI value between 25 and 50, and the "high" setting could correspond to a threshold AQI value greater than 50.

The display 700 can also present one or more affordances for controlling an operation of the robot 100. In the example shown in FIG. 9A, an affordance 714 can be selected so that an operation of the robot 100 is initiated in response to a particular air quality detected in the space 500. Like the affordance 710, when the affordance 714 is selected, an affordance 716 can be presented for selecting the threshold value at which the robot 100 is activated.

The display 700 can also present an affordance 718 for synchronizing activities of the robot 100 and the air purifier 200. In particular, in response to selection of the affordance 718, a schedule of the robot 100 can be synchronized with a schedule of the air purifier 200. When the schedules are synchronized, a change in the schedule of the robot 100 can cause the schedule of the air purifier 200 to change based on the change in the schedule of the robot 100. As discussed in this disclosure, the robot 100 and the air purifier 200 can be synchronized in such a way their operations occur at the same time or occur sequentially relative to one another.

Referring back to FIG. 8, the operation 602 can alternatively or additionally include the operation 613 to generate a recommendation for user action. This recommendation can be provided to the user at the operation 617.

In some implementations, at the operation 613, 617, a recommendation for a schedule for operating the air purifier 200 and the robot 100 is provided. The recommendation is generated at the operation 613, transmitted to the user computing device 402, and then is presented to the user through the user computing device 402 at the operation 617. The recommendation for the schedule can be generated based on information similar to that discussed in this disclosure in connection with the operations 611, 612, 615, 616 for generating control data for controlling the air purifier 200 and the robot 100. In this regard, the information can include one or more of sensor data from the robot 100, sensor data from the air purifier 200, or sensor data from other devices in the space 500, information representing an occupant schedule, information representing an environmental condition, or other information discussed in this disclosure that can be processed at the operation 602. In some examples, the recommendation for the schedule is generated based on values of air quality, e.g., detected using air quality sensors of the robot 100, the air purifier 200, or other devices in the space 500. In implementations in which the values of the air quality are collected at different times during the day on multiple different days, the computing system 650 can determine one or more time periods during the day that the air quality in the space 500 tends to be worse. The recommended schedule can be selected such that the air purifier 200 and the robot 100 are operating during these one or more periods of time. Alternatively or additionally, the recommendation can be provided if the computing system 650 determines based on information collected by the various sensors of the robot 100, the air purifier 200, and other devices in the space 500 that the occupants of the space 500 are not present in the space 500 during a particular time period. The recommended schedule can cause the robot 100 and the air purifier 200 to operate during this time period.

Figure 9B:
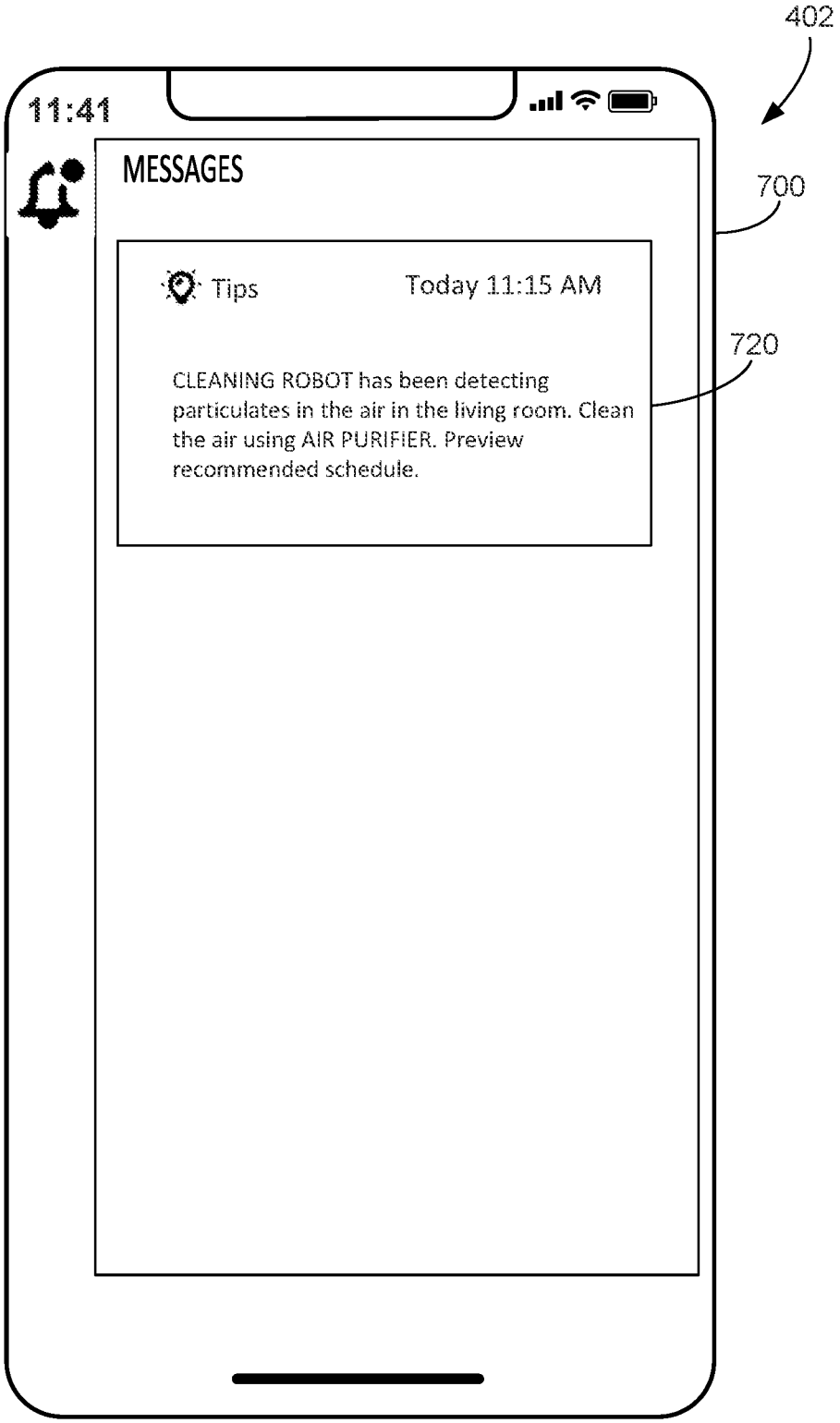

For example, referring to FIG. 9B, the display 700 of the user computing device 402 can provide a notification 720 indicating that the robot 100 has been detecting particulates in the air in the kitchen, e.g., in the second room 504 of the space 500 where the air purifier 200 is located. The notification 720 can provide an affordance selectable by the user to preview a recommended schedule for operating the air purifier 200 to filter air in the second room 504.

Figure 9C:
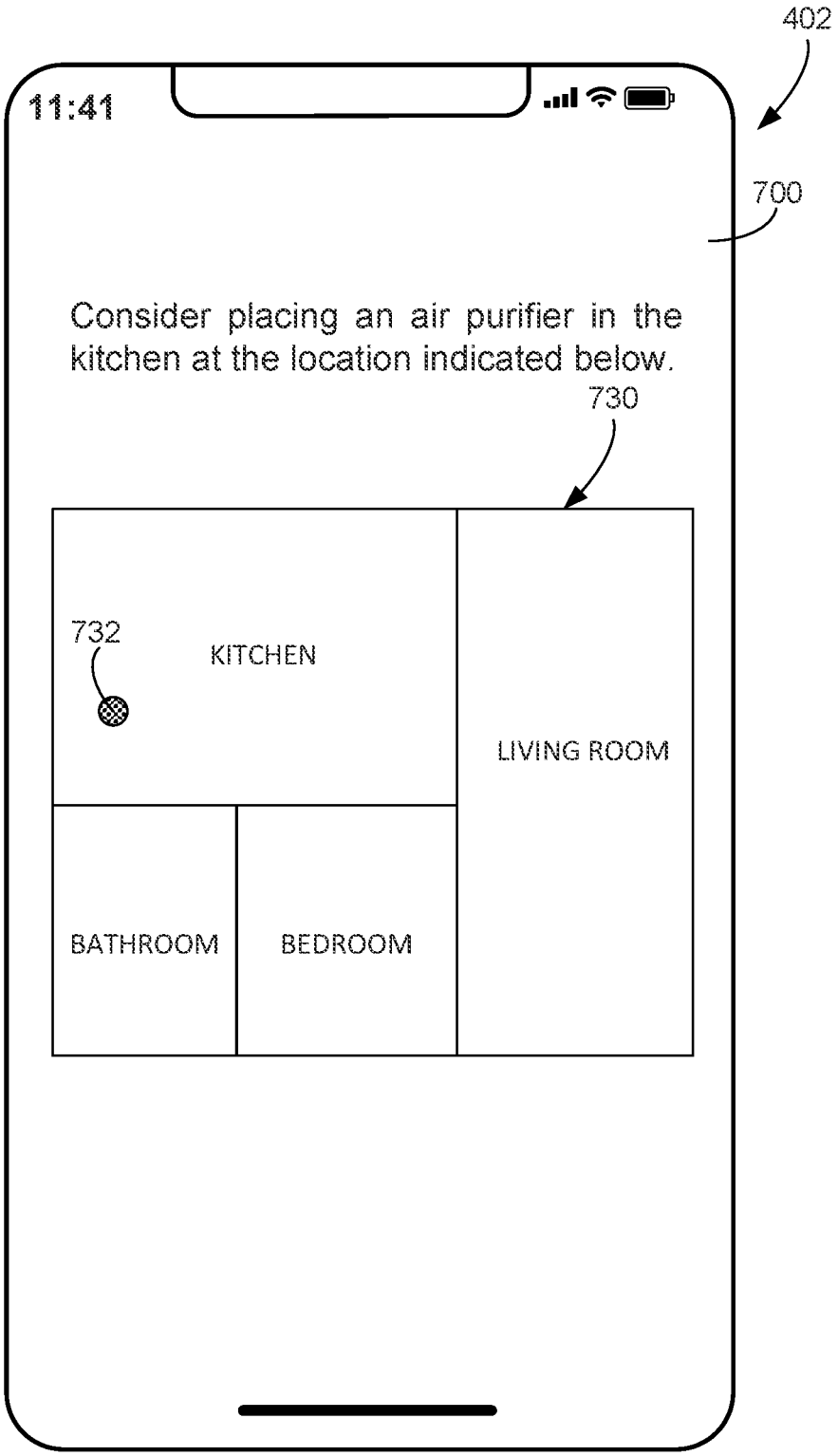
Figure 9D:
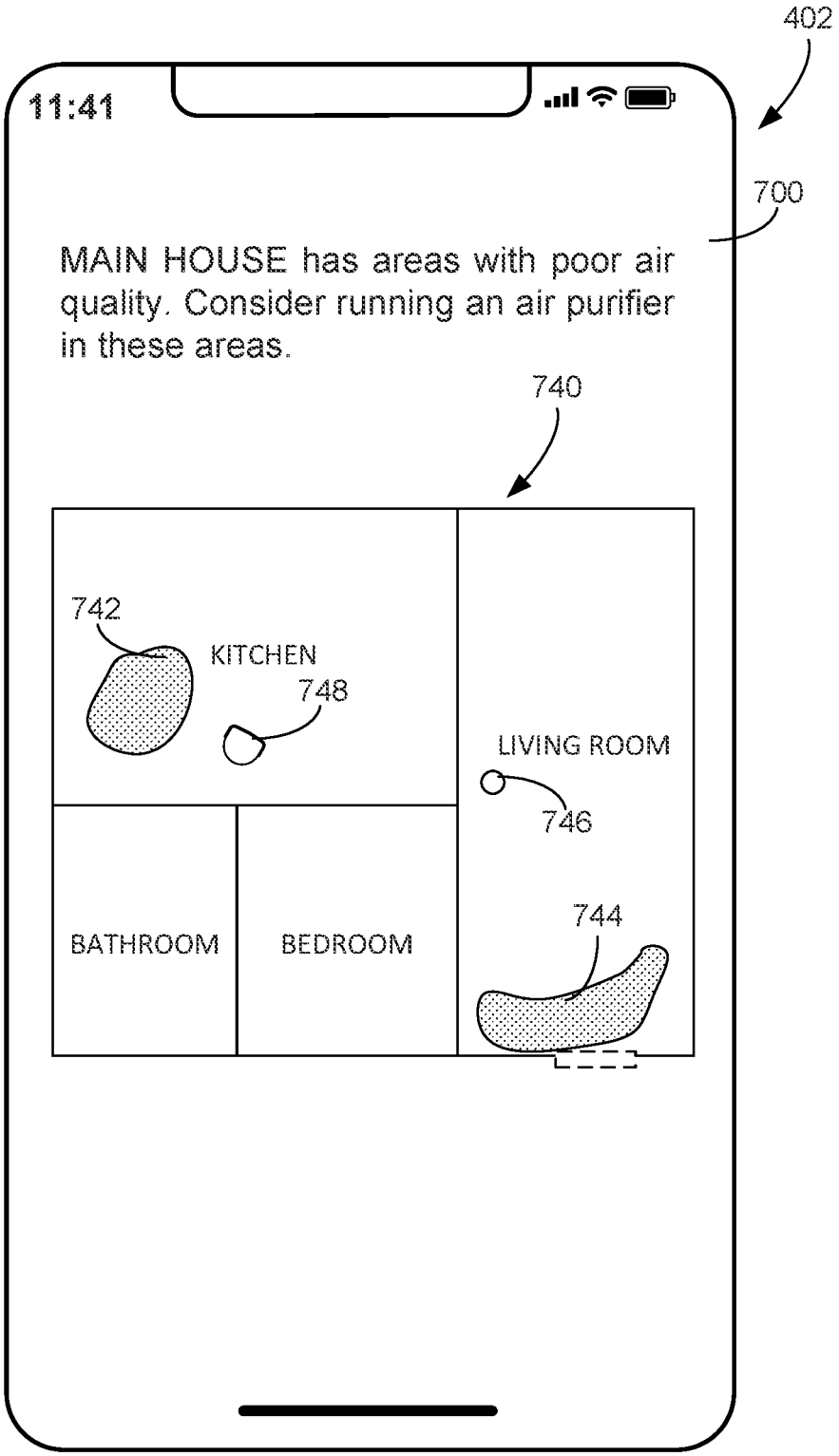

In some implementations, at the operations 613, 617, a recommendation for a location to place the air purifier 200 in the space 500 is generated and provided to the user. The recommendation can be generated based on the values of air quality in the space 500. For example, the various sensor data collected at the operation 601 can be associated with locations in the space 500. A map of the air quality values can be generated, and based on the map, the computing system 650 can determine one or more locations in the space 500 where the air quality values exceed a threshold. The computing system 650 can then generate a recommendation to place the air purifier 200 at one or more these locations, and transmit this recommendation to the user computing device 402. For example, referring to FIG. 9C, the display 700 of the user computing device 402 can present a representation 730 of a map of the space 500 and an indicator 732 of a recommended location for the air purifier 200 that is overlaid on the representation 730 of the map. The recommended location, in this example, is in the kitchen, e.g., the first room 502, and can correspond to a location in the first room 502 where air quality sensors in the space 500 detected a high amount of airborne contaminants.

In some implementations, at the operations 613, 617, a recommendation for one or more settings of the air purifier 200 or one or more settings of the robot 100 is generated and provided to the user. The recommendation can be generated based on the data indicative of the air quality in the space 500 collected at the operation 601. The one or more settings of the air purifier 200 and the one or more settings of the robot 100 can correspond to any of those discussed in this disclosure. For example, if the air quality in the space 500 is determined to be poor, e.g., exceeding a threshold, the computing system 650 can generate a recommendation to operate the air purifier 200 in a high-power mode and/or operate the robot 100 in a high-power mode.

Referring back to FIG. 8, the operation 602 can alternatively or additionally include the operation 614 to generate a map of the space 500. The map can indicate portions of the space 500 that can be traversed by the robot 100. In addition, locations on the map can be associated with the data collected at the operation 601. A representation of the map and a representation of the data can be provided to the user at the operation 618.

For example, in some implementations of the operation 614, 618, a representation of a map of the space 500 and an indicator of air quality if overlaid on the representation of the map. The representation of the map can be, for example, color-coded to indicate the air quality in the space 500. FIG.

9D provides an example of the display 700 of the user computing device 402. The display 700 presents a representation 740 of a map of the space 500. The representation 740 is coded to indicate the air quality at different locations in the space 500. For example, the display 700 can provide a first indicator 742 and a second indicator 744 of regions having high amounts of particulate matter. The particulate matter can be detected by air quality sensors on the robot 100, on air purifiers in the space 500, or on air quality sensing devices in the space 500. On the representation 740 of the map, the display 700 can provide an indicator 746 of a location of the air purifier 200 and an indicator 748 of a location of the robot 100.

In some implementations, at the operations 613, 617, a recommendation for operating one or more airflow devices in the space 500 can be provided to the user. For example, at the operation 613, the computing system 650 can generate a recommendation to open a vent, to open a window, to turn on a ceiling fan, to activate a heating, ventilation, or air conditioning system, or to operate some other airflow device in the space 500. The recommendation can be generated based on the data and information collected at the operation 601. For example, in implementations in which air quality values are measured at the operation 601, the computing system 650 can determine that there are regions in the space 500 with poorer air quality. The computing system 650 can generate the recommendation for operating the one or more airflow devices to change air circulation in the space 500 in such a way that would decrease air quality values measured in those regions.

The one or more airflow devices can be detected using sensors in the space 500, e.g., using sensors of the robot 100, the air purifier 200, the docking station 300, or the other sensing device in the space 500. For example, the image capture device 140 of the robot 100 could be used to detect locations of the one or more airflow devices.

In some implementations, the devices in the space 500, e.g., the robot 100, the air purifier 200, the docking station 300, or the other sensing devices in the space 500, can include airflow sensors that can generate sensor data indicative of airflow in the space 500. The sensors can indicate a directionality of airflow and an airflow rate at different locations in the space 500. Based on these sensor data indicative of the airflow, the computing system 650 can determine that operation of certain airflow devices can improve the circulation of air in the space 500 so as to prevent air in certain regions in the space from being too stagnant. The stagnant air could, in some examples, lead to more incidents of poor air quality. In some implementations, rather than detecting the airflow, the airflow can be modeled based on the locations of the airflow devices in the space 500. For example, the locations of windows, vents, and other airflow devices can be used to generate a predicted airflow pattern within the space 500, and this predicted airflow pattern can be used to determine whether changing the air circulation pattern in the space 500 can be used to improve air quality in certain regions in the space 500.

Figure 9E:
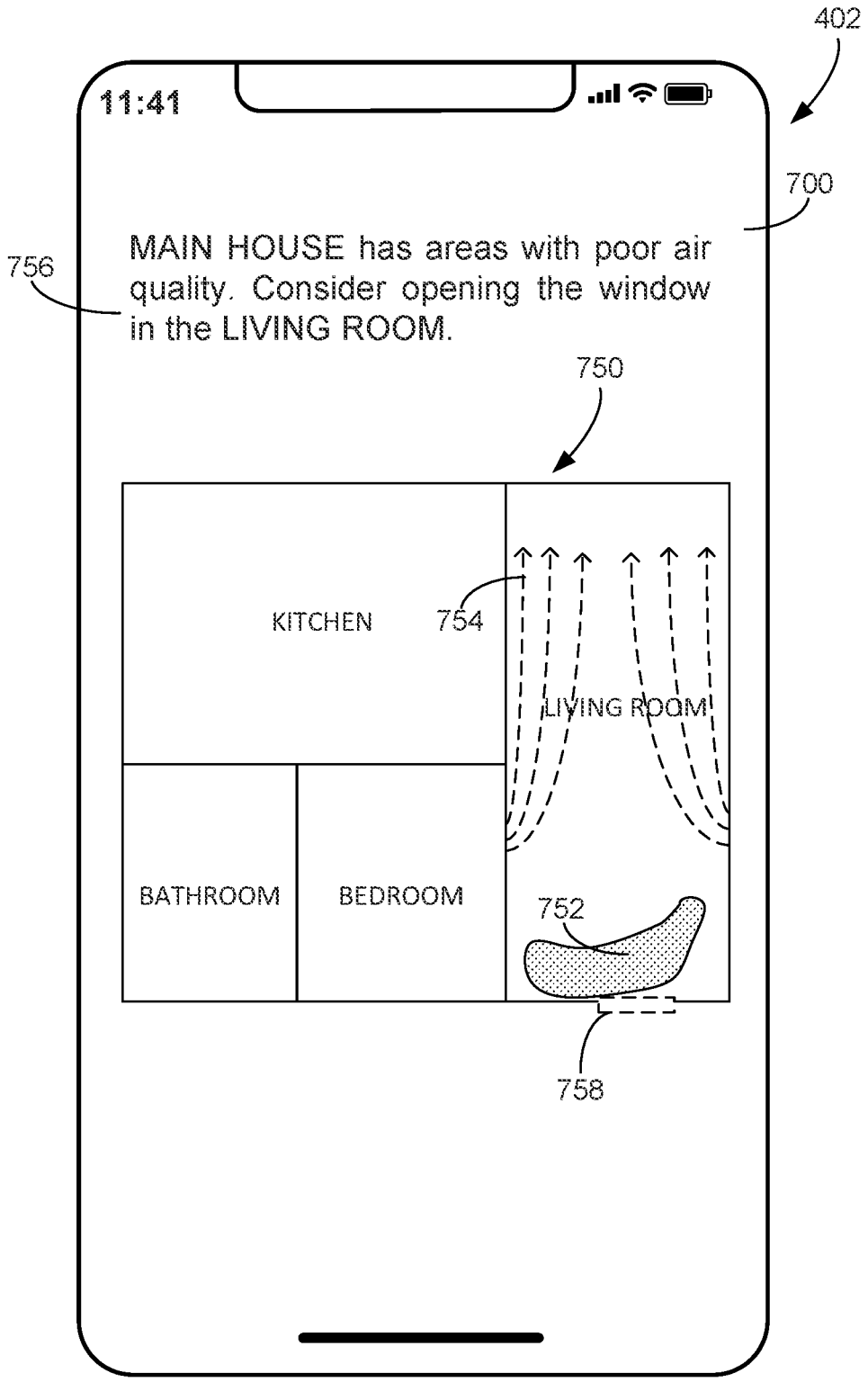

Referring to FIG. 9E, for example, the display 700 of the user computing device 402 can present a representation 750 of the space 500, and an indicator 752 of a region of the space 500 having poor air quality and an indicator 754 of the airflow in the space 500. The display 700 provides a recommendation 756 to open a window in the space 500, further providing an indicator 758 of a location of the window in the space 500. Opening the window could improve air circulation within the region having poor air quality, and thus could mitigate the poor air quality in that region.

A number of implementations have been described. Nevertheless, it will be understood that various modifications may be made.

In some implementations described in this disclosure, the robot 100, the air purifier 200, and/or the other devices 406 in the space 500 generate one or more signals and transmit the one or more signals to cause control data to be generated. The one or more signals can be indicative of sensor data collected by the robot 100, the air purifier 200, and/or the other devices 406 in the space 500. In some implementations, the one or more signals can be generated by one device and can be indicative of commands for another device. For example, the robot 100 can generate one or more signals that are indicative of a command for the air purifier 200 or the user computing device 402, or the air purifier 200 can generate one or more signals that are indicative of a command for the robot 100 or the user computing device 402. In such implementations, the one or more signals can be transmitted to the controlled device. Alternatively, the one or more signals indicative of the command can be transmitted to an intermediate device that in turn transmits control data to the controlled device. The intermediate device can be the remote server 404, the user computing device 402, or another computing device in the communication network 400.

In certain implementations, the control data are used to control the robot 100, the air purifier 200, and the user computing device 402. The control data generated at the operation 602 is generated by the computing system 650, and the computing system 650 can vary in implementations. The computing system 650 can include a processor on the robot 100, the air purifier 200, or other computing devices in the communication network 400.

For example, in implementations in which the air purifier 200 is controlled at the operations 611, 615, the computing system 650 can correspond to a computing system of the remote server 404, the robot 100, the air purifier 200, or the user computing device 402. In implementations in which the computing system 650 corresponds to a computing system on the remote server 404, the robot 100 can transmit the signal to the remote server 404 at the operation 601, and the remote server 404 can in turn generate, at the operation 611, the control data to be transmitted to the air purifier 200. In implementations in which the computing system 650 corresponds to a computing system of the robot 100 (e.g., the controller 109), the robot 100 can generate the signal at the operation 601, and the robot 100 then can transmit the signal to control an operation of the air purifier 200. In such implementations, at the operation 602, the robot 100 can generate the control data to transmit to the air purifier 200 for controlling the operation of the air purifier 200. In implementations in which the computing system 650 corresponds to a computing system of the air purifier 200 (e.g., the controller 212), the robot 100 transmits the signal to the air purifier 200, and the air purifier 200 generates the control data to control its own operations. In implementations in which the computing system 650 corresponds to a computing system of the user computing device 402, the robot 100 can transmit the signal to the user computing device 402, and the user computing device 402 can generate control data to transmit to the air purifier 200 for controlling the operation of the air purifier 200.

In further examples, in implementations in which the robot 100 is controlled at the operations 612, 616, the computing system 650 can correspond to a computing system of the remote server 404, the robot 100, the air purifier 200, or the user computing device 402. In implementations in which the computing system 650 corresponds to a computing system on the remote server 404, the air purifier 200 can transmit a signal to the remote server 404 at the operation 601, and the remote server 404 can in turn generate, at the operation 612, the control data to be transmitted to the robot 100. In implementations in which the computing system 650 corresponds to a computing system of the air purifier 200 (e.g., the controller 212), the air purifier 200 can generate the signal, and the air purifier 200 then can transmit the signal to control an operation of the robot 100. In such implementations, at the operation 602, the air purifier 200 can generate the control data to transmit to the robot 100 for controlling the operation of the air purifier 200. In implementations in which the computing system 650 corresponds to a computing system of the robot 100 (e.g., the controller 109), the air purifier 200 transmits the signal to the robot 100, and the robot 100 generates the control data to control its own operations. In implementations in which the computing system 650 corresponds to a computing system of the user computing device 402, the air purifier 200 can transmit the signal to the user computing device 402, and the user computing device 402 can generate control data to transmit to the robot 100 for controlling the operation of the robot 100.

In further examples, in implementations in which the user computing device 402 is controlled at the operations 613, 614, 617, 618, the computing system 650 can correspond to a computing system of the remote server 404, the robot 100, or the air purifier 200. In some implementations, the computing system 650 corresponds to a computing system on the remote server 404. In such implementations, the robot 100, the air purifier 200, the other connected devices 406, or any combination thereof can transmit one or more signals to the remote server 404 at the operation 601, and the remote server 404 can in turn generate, at the operation 613 or 614, the control data to be transmitted to the user computing device 402. In some implementations, the computing system 650 corresponds to a computing system of the user computing device 402. In such implementations, the remote server 404, the robot 100, the air purifier 200, the other connected devices 406, or any combination thereof can transmit one or more signal to the user computing device 402, and the user computing device 402 can generate control data to control its own operations.

The subject matter and the actions and operations described in this disclosure can be implemented in digital electronic circuitry, in tangibly-embodied computer software or firmware, in computer hardware, including the structures disclosed in this disclosure and their structural equivalents, or in combinations of one or more of them. The subject matter and the actions and operations described in this disclosure can be implemented as or in one or more computer programs, e.g., one or more modules of computer program instructions, encoded on a computer program carrier, for execution by, or to control the operation of, data processing apparatus. The carrier can be a tangible non-transitory computer storage medium. Alternatively or in addition, the carrier can be an artificially generated propagated signal, e.g., a machine-generated electrical, optical, or electromagnetic signal, that is generated to encode information for transmission to suitable receiver apparatus for execution by a data processing apparatus. The computer storage medium can be or be part of a machine-readable storage device, a machine-readable storage substrate, a random or serial access memory device, or a combination of one or more of them. A computer storage medium is not a propagated signal.

The term "data processing apparatus" encompasses all kinds of apparatus, devices, and machines for processing data, including by way of example a programmable processor, a computer, or multiple processors or computers. Data processing apparatus can include special-purpose logic circuitry, e.g., an FPGA (field programmable gate array), an ASIC (application specific integrated circuit), or a GPU (graphics processing unit). The apparatus can also include, in addition to hardware, code that creates an execution space for computer programs, e.g., code that constitutes processor firmware, a protocol stack, a database management system, an operating system, or a combination of one or more of them.

A computer program can be written in any form of programming language, including compiled or interpreted languages, or declarative or procedural languages; and it can be deployed in any form, including as a standalone program, e.g., as an app, or as a module, component, engine, subroutine, or other unit suitable for executing in a computing space, which space may include one or more computers interconnected by a data communication network in one or more locations.

A computer program may, but need not, correspond to a file in a file system. A computer program can be stored in a portion of a file that holds other programs or data, e.g., one or more scripts stored in a markup language document, in a single file dedicated to the program in question, or in multiple coordinated files, e.g., files that store one or more modules, sub programs, or portions of code.

The processes and logic flows described in this disclosure can be performed by one or more computers executing one or more computer programs to perform operations by operating on input data and generating output. The processes and logic flows can also be performed by special-purpose logic circuitry, e.g., an FPGA, an ASIC, or a GPU, or by a combination of special-purpose logic circuitry and one or more programmed computers.

Computers suitable for the execution of a computer program can be based on general or special-purpose microprocessors or both, or any other kind of central processing unit. Generally, a central processing unit will receive instructions and data from a read only memory or a random access memory or both. The essential elements of a computer are a central processing unit for executing instructions and one or more memory devices for storing instructions and data. The central processing unit and the memory can be supplemented by, or incorporated in, special-purpose logic circuitry.

Generally, a computer will also include, or be operatively coupled to, one or more mass storage devices, and be configured to receive data from or transfer data to the mass storage devices. The mass storage devices can be, for example, magnetic, magneto optical, or optical disks, or solid state drives.

To provide for interaction with a user, the subject matter described in this disclosure can be implemented on one or more computers having, or configured to communicate with, a display device, e.g., a LCD (liquid crystal display) monitor, or a virtual-reality (VR) or augmented-reality (AR) display, for displaying information to the user, and an input device by which the user can provide input to the computer, e.g., a keyboard and a pointing device, e.g., a mouse, a trackball or touchpad. Other kinds of devices can be used to provide for interaction with a user as well; for example, feedback and responses provided to the user can be any form of sensory feedback, e.g., visual, auditory, speech or tactile; and input from the user can be received in any form, including acoustic, speech, or tactile input, including touch motion or gestures, or kinetic motion or gestures or orientation motion or gestures. In addition, a computer can interact with a user by sending documents to and receiving documents from a device that is used by the user; for example, by sending web pages to a web browser on a user's device in response to requests received from the web browser, or by interacting with an app running on a user device, e.g., a smartphone or electronic tablet. Also, a computer can interact with a user by sending text messages or other forms of message to a personal device, e.g., a smartphone that is running a messaging application, and receiving responsive messages from the user in return.

The computing system can include clients and servers. A client and server are generally remote from each other and typically interact through a communication network. The relationship of client and server arises by virtue of computer programs running on the respective computers and having a client-server relationship to each other. In some implementations, a server transmits data, e.g., an HTML, page, to a user device, e.g., for purposes of displaying data to and receiving user input from a user interacting with the device, which acts as a client. Data generated at the user device, e.g., a result of the user interaction, can be received at the server from the device.

Accordingly, other implementations are within the scope of the claims.

What is claimed is:

1. An autonomous cleaning robot comprising:

a drive system to move the autonomous cleaning robot about a floor surface in a space;

a cleaning system to clean a floor surface in the space as the drive system moves the autonomous cleaning robot about the floor surface; and a controller configured to execute instructions to perform one or more operations comprising:

initiating a cleaning mission to clean the floor surface in the space, wherein the cleaning system of the autonomous cleaning robot is active while the autonomous cleaning robot performs the cleaning mission, determining a target operation of an air purifier remote from the autonomous cleaning robot, wherein the target operation comprises initiating a first mode of the air purifier, the air purifier operable in the first mode and in a second mode, wherein a fan speed of the air purifier in the first mode is greater than the fan speed of the air purifier in the second mode, and transmitting a signal to cause the air purifier to perform the target operation as the autonomous cleaning robot performs the cleaning mission.

2. The autonomous cleaning robot of claim 1, wherein transmitting the signal to cause the air purifier to perform the target operation comprises:

causing the air purifier to activate in response to the autonomous cleaning robot being in a room in which the air purifier is located.

3. The autonomous cleaning robot of claim 1, wherein the one or more operations comprises:

receiving data to cause the autonomous cleaning robot to perform a cleaning operation, the cleaning operation selected based on at least data indicative of air quality measured by the air purifier.

4. The autonomous cleaning robot of claim 1, wherein the one or more operations comprises:

receiving data to cause the autonomous cleaning robot to perform a cleaning operation at a scheduled time, the scheduled time selected based on at least data indicative of air quality measured by the air purifier.

5. The autonomous cleaning robot of claim 1, further comprising:

an air quality sensor to measure air quality in the space as the drive system moves the autonomous cleaning robot moves about the floor surface.

6. The autonomous cleaning robot of claim 5, wherein the one or more operations comprises:

initiating a mission in which the autonomous cleaning robot moves about the floor surface while using the air quality sensor to measure the air quality while the cleaning system is inactive.

7. The autonomous cleaning robot of claim 1, wherein the one or more operations further comprises:

receiving data indicative of priorities for cleaning a plurality of rooms in the space during the cleaning mission, the plurality of rooms comprising the room, the priorities selected based on at least values of air quality in the plurality of rooms in the space.

8. The autonomous cleaning robot of claim 1, further comprising a sensor to detect debris in the space, wherein transmitting the signal to cause the air purifier to perform the target operation comprises transmitting data indicative of the detected debris.

9. The autonomous cleaning robot of claim 1, further comprising a sensor to detect a floor type in the space, wherein determining the target operation comprises determining the target operation based on the detected floor type.

10. The autonomous cleaning robot of claim 1, wherein the target operation comprises the air purifier operating for a predefined duration.

11. The autonomous cleaning robot of claim 1, wherein the target operation comprises the air purifier operating at an adjusted frequency, the adjusted frequency based on an amount of floor particulate detected by the autonomous cleaning robot.

12. A method comprising:

receiving data indicative of a location of an autonomous cleaning robot while the autonomous cleaning robot performs a cleaning mission to clean a space;

determining that the location of the autonomous cleaning robot is in a room in the space in which an air purifier is located; and initiating an operation of the air purifier in response to determining that the location of the autonomous cleaning robot is in the room, wherein initiating the operation comprises increasing a fan speed of the air purifier from a first speed to a second speed while the autonomous cleaning robot performs the cleaning mission, wherein the first speed is greater than zero.

13. The method of claim 12, further comprising synchronizing a schedule of the air purifier with a schedule of the autonomous cleaning robot.

14. The method of claim 12, further comprising:

receiving data indicative of an occupant schedule indicating a time period in which an occupant is absent from the room in the space; and initiating the cleaning mission of the autonomous cleaning robot only during the time period.

15. The method of claim 12, further comprising:

receiving, from a plurality of air quality sensors in the space, data indicative of values of air quality in a plurality of rooms in the space.

16. The method of claim 12, comprising:

initiating a second operation of the air purifier in response to determining that the air purifier is within a predefined distance of the autonomous cleaning robot.

17. The method of claim 12, wherein initiating the operation comprises setting the fan speed to the second speed for a predefined duration.

18. An air purifier comprising:

a base to support the air purifier above a floor surface in a space;

a fan system to draw air into the air purifier;

a filter to capture particles in the air drawn into the air purifier by the fan system; and a controller configured to execute instructions to perform one or more operations comprising:

adjusting a setting of the fan system in response to an autonomous cleaning robot, during a cleaning mission, entering into a region in the space within which the air purifier is located, wherein adjusting the setting of the fan system comprises initiating a first mode of the air purifier while the autonomous cleaning robot performs the cleaning mission, the air purifier operable in the first mode and in a second mode, wherein a fan speed of the air purifier in the first mode is greater than a fan speed of the air purifier in the second mode, and wherein the fan speed of the air purifier in the second mode is greater than zero.

19. The air purifier of claim 18, wherein the one or more operations further comprises:

receiving data indicative an air quality measured by an air quality sensor of the autonomous cleaning robot; and activating the fan system in response to the measured air quality.

20. The air purifier of claim 18, wherein the one or more operations further comprises:

adjusting the setting of the fan system based on at least data indicative of debris detected in the space by the autonomous cleaning robot.

21. The air purifier of claim 18, wherein the one or more operations further comprises:

adjusting the setting of the fan system based on at least data indicative of a floor type in the space by the autonomous cleaning robot.

22. The air purifier of claim 18, further comprising a drive system to move the air purifier about the floor surface.

* * * * *